US010132203B2

(12) United States Patent
Okada

(10) Patent No.: US 10,132,203 B2
(45) Date of Patent: Nov. 20, 2018

(54) INTERNAL COMBUSTION ENGINE

(71) Applicant: HONDA MOTOR CO., LTD., Tokyo (JP)

(72) Inventor: Nozomi Okada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 74 days.

(21) Appl. No.: 15/440,248

(22) Filed: Feb. 23, 2017

(65) Prior Publication Data

US 2017/0276029 A1 Sep. 28, 2017

(30) Foreign Application Priority Data

Mar. 22, 2016 (JP) ..... 2016-057457

(51) Int. Cl.
*F01L 1/18* (2006.01)
*F01L 1/08* (2006.01)
(Continued)

(52) U.S. Cl.
CPC ..... *F01L 1/185* (2013.01); *F01L 1/047* (2013.01); *F01L 1/08* (2013.01); *F01L 1/262* (2013.01); *F01L 2001/0537* (2013.01); *F01L 2003/256* (2013.01); *F01L 2103/00* (2013.01); *F01L 2250/02* (2013.01); *F01L 2250/06* (2013.01); *F02B 2275/18* (2013.01)

(58) Field of Classification Search
CPC ..... F01L 1/08; F01L 13/0042; F01L 1/185; F01L 1/262; F01L 2001/0537; F01L 2103/00; F01L 1/047; F01L 2250/06; F01L 2250/02; F01L 2003/256; F02B 2275/18
See application file for complete search history.

(56) References Cited

U.S. PATENT DOCUMENTS 4,617,881 A * 10/1986 Aoi ..... F01L 1/185 123/90.22
5,347,964 A * 9/1994 Reguiero ..... F01L 1/024 123/302

(Continued)

FOREIGN PATENT DOCUMENTS

DE 10 2013 215 081 A1 4/2014
JP 2000-045719 A 2/2000

OTHER PUBLICATIONS

European Search Report application No. 17160027.3 dated Aug. 24, 2017.

*Primary Examiner* — Mark A Laurenzi
*Assistant Examiner* — Wesley G Harris
(74) *Attorney, Agent, or Firm* — Squire Patton Boggs (US) LLP

(57) ABSTRACT

An internal combustion engine optimizing small-size arrangement of the valve drive mechanism, considering that the exhaust valve diameter is smaller than the intake valve diameter.

Intake and exhaust valves are in a radial arrangement, intake and exhaust cam surfaces are inclined relative to intake and exhaust cam axes, intake and exhaust rocker arm support members are inclined correspondingly in the same way and disposed between an intake camshaft and an exhaust camshaft. Pivotal support base portions of intake rocker arms and pivotal support base portions of exhaust rocker arms are disposed such that the distances thereof from a joining surface joining a cylinder head and a cylinder body are different.

6 Claims, 19 Drawing Sheets

(51) Int. Cl.

| | |
|---|---|
| ***F01L 1/047*** | (2006.01) |
| ***F01L 1/26*** | (2006.01) |
| *F01L 1/053* | (2006.01) |
| *F01L 3/00* | (2006.01) |

(56) References Cited

U.S. PATENT DOCUMENTS

| | | | | |
|---|---|---|---|---|
| 6,125,807 | A * | 10/2000 | Nishi | F01L 1/024 123/90.27 |
| 6,170,449 | B1 | 1/2001 | Saiki et al. | |
| 2007/0144477 | A1 | 6/2007 | Matsuda | |
| 2010/0050968 | A1 * | 3/2010 | Emmersberger | F01L 1/053 123/90.23 |

* cited by examiner

INTERNAL COMBUSTION ENGINE

TECHNICAL FIELD

The present invention relates to an internal combustion engine including a valve drive mechanism in which intake valves and exhaust valves are disposed in radial arrangement and opened and closed by intake cams and exhaust cams through rocker arms.

BACKGROUND ART

In an internal combustion engine wherein a pair of intake valves and a pair of exhaust valves are disposed in radial arrangement, a rocker shaft of the intake side and a rocker shaft of the exhaust side, supporting rocker arms, are heretofore disposed at the same height, the rocker arms pressing the intake valves and the exhaust valves, and holders supporting these rocker shafts on the intake side and the exhaust side are arranged also at the same height (refer to Patent Document 1).

In general, the diameter of the exhaust valves is smaller than diameter of the intake valves. However, prior art internal combustion engines are not designed in consideration of this. Therefore, an optimum arrangement of the valve drive mechanism and an optimum setting of the angle of radial arrangement of the intake valves and the exhaust valves as well as miniaturization of the engine head portion have been underlying problems.

PRIOR ART DOCUMENT

Patent Document

[Patent Document 1] JP 2000-45719 A

SUMMARY OF INVENTION

Underlying Problem to be Solved by the Invention

The internal combustion engine according to the present invention has been made in order to overcome the problems described above, and its object is to provide an internal combustion engine enabling an optimum arrangement of the valve drive mechanism, with a most proper setting of the angle of radial arrangement of the valves, and enabling miniaturization of the cylinder head portion of the engine in consideration of the general design that the diameter of the exhaust valves is smaller than the diameter of the intake valves.

Solution to the Problem

To attain the above object, the present invention provides an internal combustion engine, comprising: a cylinder body having a cylinder bore with a cylinder axis; a cylinder head joined to the cylinder body on a joining surface; a pair of intake valves and a pair of exhaust valves; an intake camshaft having intake cams for pressing the intake valves, respectively; an exhaust camshaft having exhaust cams for pressing the exhaust valves, respectively; intake rocker arms interposed between the intake cams and the intake valves, respectively; an exhaust rocker arms interposed between the exhaust cams and the exhaust valves, respectively; intake rocker arm support members for pivotably supporting pivotal support base portions of the intake rocker arms, respectively; and exhaust rocker arm support members for pivotably supporting pivotal support base portions of the exhaust rocker arms, respectively:

wherein the intake valves and the exhaust valves are disposed in radial directions with respect to the cylinder axis; the intake cams include intake cam surfaces inclined at inclination angles relative to an axis of the intake camshaft, respectively; the intake rocker arm support members are disposed to incline at inclination angles corresponding to the inclination angle of the intake cam surfaces, respectively; the exhaust cams include exhaust cam surfaces inclined at inclination angles relative to an axis of the exhaust camshaft, respectively; the exhaust rocker arm support members are disposed to incline at inclination angles corresponding to the inclination angle of the exhaust cam surfaces, respectively; the intake rocker arm support members and the exhaust rocker arm support members are disposed between the intake camshaft and the exhaust camshaft as viewed along the cylinder axis; and the pivotal support base portions of the intake rocker arms and the pivotal support base portions of the exhaust rocker arms are disposed such that distances from the joining surface to the intake rocker arm support members and to the exhaust rocker arm support members are different.

According to the above configuration, the intake rocker arm support members and the exhaust rocker arm support members are disposed between the intake camshaft and the exhaust camshaft as viewed along the cylinder axis, and the pivotal support base portions of the intake rocker arms and the pivotal support base portions of the exhaust rocker arms are disposed such that the distances thereof from the joining surface joining the cylinder head and the cylinder body are different. Therefore, the valve drive mechanism can be formed compactly and the internal combustion engine can be miniaturized while interference of the pivotal support base portions of the intake rocker arms and the pivotal support base portions of the exhaust rocker arms is prevented, under the condition that the diameter of the intake valves is smaller than the diameter of the exhaust valves. Further, the positions of the pivotal support base portions of the rocker arms on the intake side and the exhaust side are set so that the distances from the joining surface joining the cylinder head and the cylinder body are different according to the valve diameter and the lift amount of the intake and exhaust valves. As a result, arrangement of the valve drive mechanism and the angle of radial arrangement can be optimized. Further, by differentiating the height of the pivotal support base portions of the intake rocker arms and the height of the pivotal support base portions of the exhaust rocker arms, the intake rocker arms and the exhaust rocker arms can be disposed so as to be closer to the center area between the intake camshaft and the exhaust camshaft, an increased length of the rocker arms can be secured, and inclination of the cam follower portions of the rocker arms can be reduced.

In a preferred form of the invention, the intake rocker arm support members are intake rocker arm support pins, the exhaust rocker arm support members are exhaust rocker arm support pins, the intake rocker arm support pins and the exhaust rocker arm support pins being inserted in a rocker arm support boss portion formed integrally on the cylinder head; and the intake rocker arm support pins and the exhaust rocker arm support pins are prevented from slipping off by slipping-off preventing members, which are shared by both the intake rocker arm support pins and the exhaust rocker arm support pins.

According to this configuration, the number of the component parts can be reduced and assembling work can be improved because the intake rocker arm support pins and the exhaust rocker arm support pins share the slipping-off preventing member. Further, because the intake rocker arms and the exhaust rocker arms are supported by the intake rocker arm support pins and the exhaust rocker arm support pins with the intake rocker arm support pin and the exhaust rocker arm support pin being inserted in the rocker arm support boss portion, the intake rocker arms and the exhaust rocker arms can be securely supported by a simple structure, and the assembling work can be further improved.

In a preferred form of the invention, the slipping-off preventing members are disposed so as to incline relative to the cylinder axis, and the intake rocker arm support pins and the exhaust rocker arm support pins are prevented from slipping off, respectively, by a base portion and a tip portion of the slipping-off preventing members.

According to this configuration, the intake rocker arm support pins and the exhaust rocker arm support pins can be disposed closer to the center region between the intake camshaft and the exhaust camshaft while the distance between the intake rocker arm support pins and the exhaust rocker arm support pins is enlarged by the slipping-off preventing member disposed so as to incline relative to the cylinder axis. Therefore the cylinder head can be further miniaturized while the slipping-off preventing member is shared, arrangement of the valve drive mechanism and the angle of the radial arrangement can be optimized, and inclination of the cam follower portions can be reduced by securing the length of the rocker arms.

In a further preferred form of the invention, each of the slipping-off preventing members is formed such that the tip portion thereof has a reduced diameter relative to the base portion thereof; and the slipping-off preventing member includes a thread portion provided between the base portion and the tip portion, the thread portion fixing the slipping-off preventing member to the cylinder head.

According to the configuration described above, because the thread portion of the slipping-off preventing member is arranged between the base portion and the tip portion, both the intake rocker arm support pin and the exhaust rocker arm support pin can be securely fixed by the thread portion in the center area while the intake rocker arm support pin and the exhaust rocker arm support pin are disposed apart, and the supporting rigidity can be increased.

In a still further preferred form of the invention, the cylinder head has camshaft support portions for supporting the intake camshaft and the exhaust camshaft; a camshaft holder is fixed integrally on the camshaft support portions and rotatably supports intake camshaft and the exhaust camshaft; the camshaft support portions and the camshaft holder are joined on a joining surface, the joining surface being inclined relative to the joining surface joining the cylinder body and the cylinder head;

the exhaust rocker arm support pins are inserted in the rocker arm support boss portion on a side where the distance between the joining surface and the joining surface is shorter; and the intake rocker arm support pin are inserted in the rocker arm support boss portion on a side where the distance between the joining surface and the joining surface is longer.

According to the configuration described above, the exhaust rocker arm support pins are inserted in the rocker arm support boss portion on the side where the distance between the joining surface joining the camshaft support portion with the camshaft holder and the joining surface joining the cylinder head with the cylinder body is smaller, the intake rocker arm support pins are inserted in the rocker arm support boss portions on the side where the distance is longer in the cylinder head in which the joining surface joining the camshaft support portion with the camshaft holder inclines relative to the joining surface joining the cylinder head with the cylinder body. Therefore the side of the shorter distance can be made the side of the exhaust valves having a smaller valve diameter and the side of the longer distance can be made the side of the intake valves having a larger valve diameter, whereby the valve drive mechanism can be optimally formed in the cylinder head, and the cylinder head can be miniaturized.

In a preferred form of the invention, the rocker arm support boss portion of the cylinder head has positioning grooves formed in the surface of the rocker arm support boss portion, the positioning grooves receiving the pivotal support base portions of the intake rocker arms and the pivotal support base portions of the exhaust rocker arms, respectively.

According to the above configuration, the positioning grooves are arranged in the rocker arm support boss portion in the surface of the rocker arm support boss portion, and the positioning grooves receive therein the pivotal support base portions of the intake rocker arms and the pivotal support base portions of the exhaust rocker arms. Therefore the positioning grooves can be made lubrication grooves for capturing the oil splashed to the rocker arm support boss portion and for supplying the oil to the pivotal support base portions of the intake rocker arms and the exhaust rocker arms, and the lubrication performance of the pivotal support base portions of the intake rocker arms and the pivotal support base portions of the exhaust rocker arms by the oil can be improved.

Advantageous Effects of Invention

According to the present invention, the valve drive mechanism can be arranged compactly and the internal combustion engine can be miniaturized while interference of the pivotal support base portions of the intake rocker arms and the pivotal support base portions of the exhaust rocker arms is prevented, under the condition that the valve diameter of the intake valves and the valve diameter of the exhaust valves are different from each other. Further, a required length of the rocker arms can be secured, inclination of the cam follower portions of the rocker arms can be reduced, and arrangement of the valve drive mechanism and the angle of radial arrangement of the valves can be optimized.

DESCRIPTION OF EMBODIMENTS OF THE INVENTION

Figure 1:
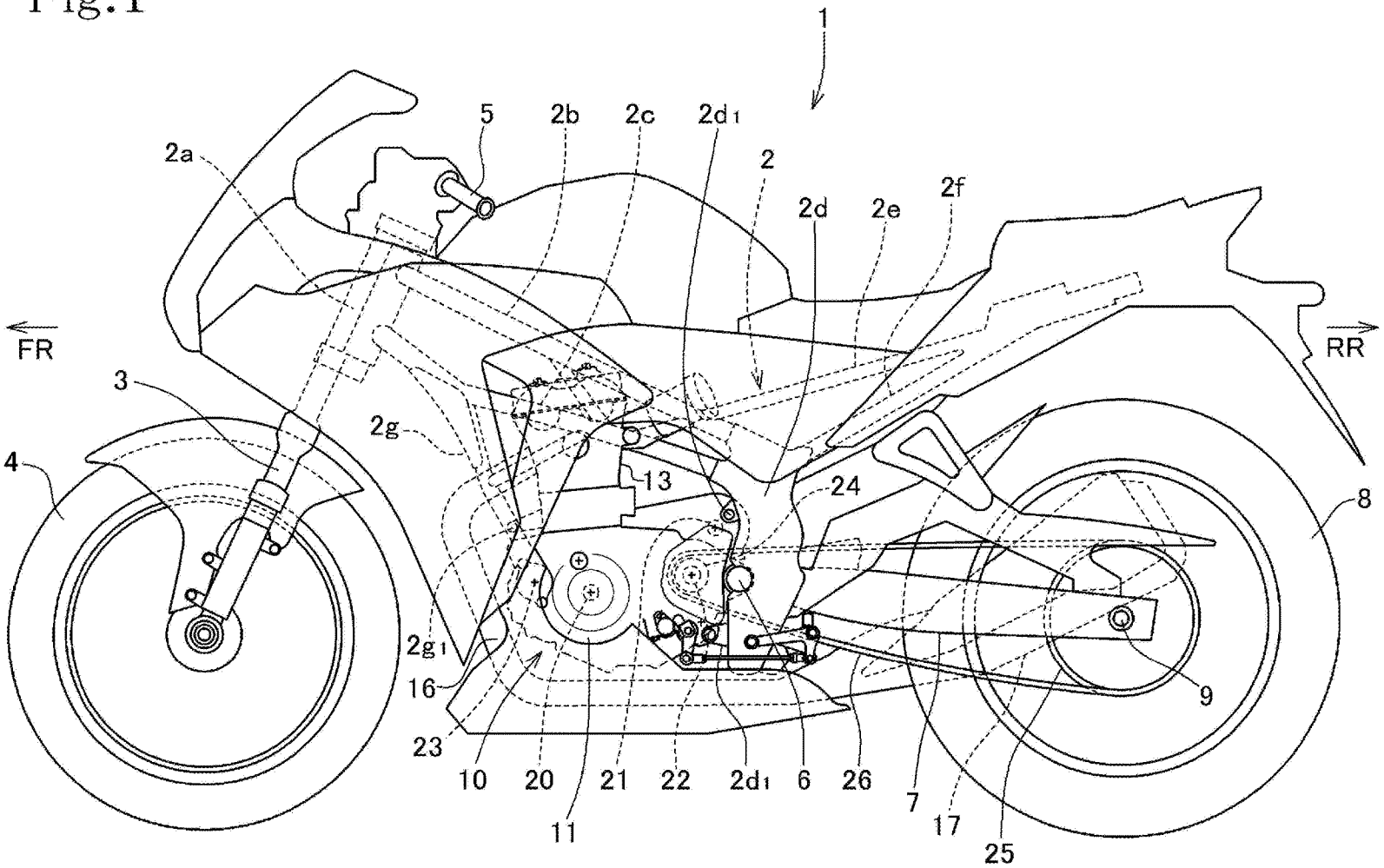
FIG. 1 is a left side view of a motorcycle on which is mounted an internal combustion engine according to an embodiment of the present invention.

An internal combustion engine according to an embodiment of the present invention will be described with reference to the drawings. FIG. 1 is a side view of a motorcycle 1 that is a saddle-ride type vehicle equipped with the internal combustion engine according to an embodiment of the present invention. In the description, the directions of front, rear, left, and right are according to the normal reference in which the advancing direction of the motorcycle 1 used in the present embodiment is a forward or front direction. In the drawings, FR represents forward, RR represents rearward, LH represents leftward, and RH represents rightward.

As shown in FIG. 1, with respect to a body frame 2 of the motorcycle 1, a pair of left and right upper main frame members 2*b* and lower main frame members 2*c* extend obliquely downward to the rear from a head pipe 2*a*, and the rear ends of the upper main frame members 2*b* and the lower main frame members 2*c* are connected to a center frame portion 2*d*. From the rear part of the upper main frame members 2*b* and the lower main frame member 2*c*, a seat rails 2*e* extend obliquely upward to the rear, and an auxiliary frame portion 2*f* connects the seat rails 2*e* and the center frame portion 2*d*. From the front part of the lower main frame members 2*c*, a down frame 2*g* branches and extends downward and obliquely rearward.

A front fork 3 extending downward is steerably supported by the head pipe 2*a*. A front wheel 4 is rotatably supported by the lower end of the front fork 3. A steering handlebar 5 is joined integrally to the upper end of the front fork 3.

An internal combustion engine 10 mounted on the present motorcycle 1 is a water-cooled one-cylinder 4-stroke cycle internal combustion engine, and is supported and suspended by both a support bracket $2d_1$ protruding on the center frame portion 2*d* of the body frame 2 and a lower end $2g_1$ of the down frame portion 2*g*. The internal combustion engine 10 is mounted on the body frame 2 so as to be so-called laterally mounted with a crankshaft 20 oriented in the left and right width direction of the vehicle body. The crankshaft 20 is supported by a crankcase 11 in a rotatable manner. With respect to the internal combustion engine 10, as shown in FIG. 2, a cylinder body 12 and a cylinder head 13 are laid sequentially over the crankcase 11 and are fastened integrally by stud bolts 19 (refer to FIG. 5), and the upper part of the cylinder head 13 is covered by a cylinder head cover 14.

Figure 2:
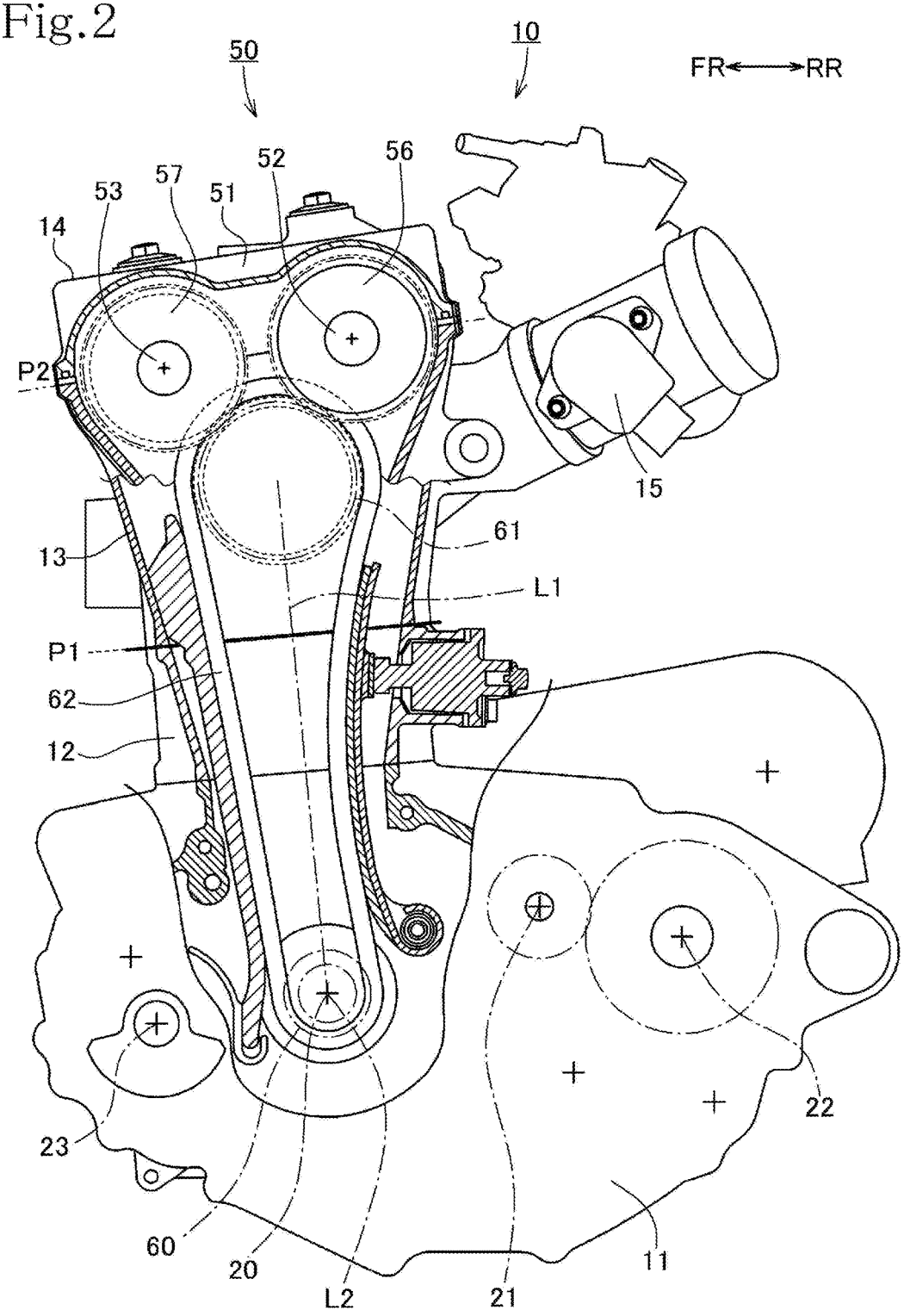
FIG. 2 is a vertical cross-sectional view of a part of the internal combustion engine, taken along a plane in which an endless timing chain passes.

As shown in FIG. 2, the crankcase 11 of the present internal combustion engine 10 has a construction having therein a transmission (not illustrated) behind the crankshaft 20, a main shaft 21 and a countershaft 22, the main shaft 21 and the countershaft 22 respectively supporting transmission gears which are in meshing engagement with each other. Out of the main shaft 21 and the countershaft 22, the countershaft 22 is an output shaft, and a driving chain sprocket 24 is fixedly mounted on an end of the countershaft 22 as shown in FIG. 1, the end penetrating the left side wall of the crankcase 11 and protruding to the outside. The engine 10 is of one-cylinder type, and a balancer shaft 23 is arranged as shown in FIG. 2, the balancer shaft 23 reducing primary vibrations of the internal combustion engine 10.

As shown in FIG. 1, a swing arm 7 extends rearward in a vertically swingable manner, the front end of the swing arm 7 being pivotally supported by the center frame portion 2*d* of the body frame 2 through a pivot shaft 6, and a rear wheel 8 is provided at the rear end of the swing arm 7 so as to be rotatably supported by a rear axle 9. An endless driving chain 26 is extended between a driven chain sprocket 25 and the driving chain sprocket 24, the driven chain sprocket 25 being fitted to the rear axle 9, and the power of the crankshaft 20 is transmitted to the rear wheel 8.

Figure 3:
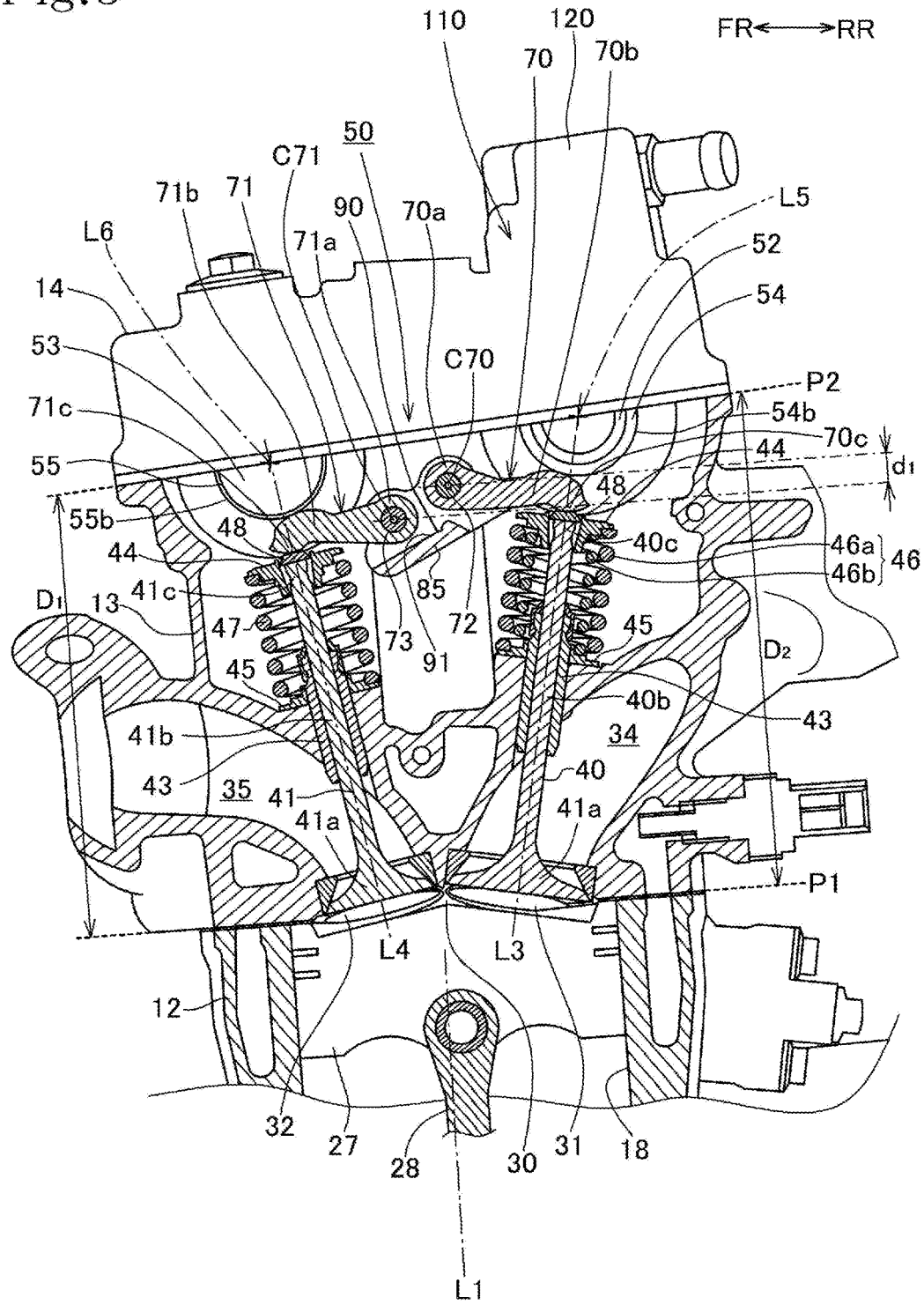
FIG. 3 is an enlarged vertical cross-sectional view of an essential part of the engine, taken on a plane passing through an intake valve and an exhaust valve.

As shown in FIG. 3, the cylinder body 12 has therein a vertically penetrating cylinder bore 18, a piston 27 is fitted in the cylinder bore 18 in a vertically slidable manner, and a crank pin (not illustrated) of the crankshaft 20 is connected to the piston 27 through a connecting rod 28. A combustion chamber 30 is formed in the cylinder head 13, and the combustion energy in the combustion chamber 30 of the engine 10 is converted into the kinetic energy of the piston 27. The piston 27 is thereby moved vertically and the crankshaft 20 is driven in rotation through the connecting rod 28.

Figure 4:
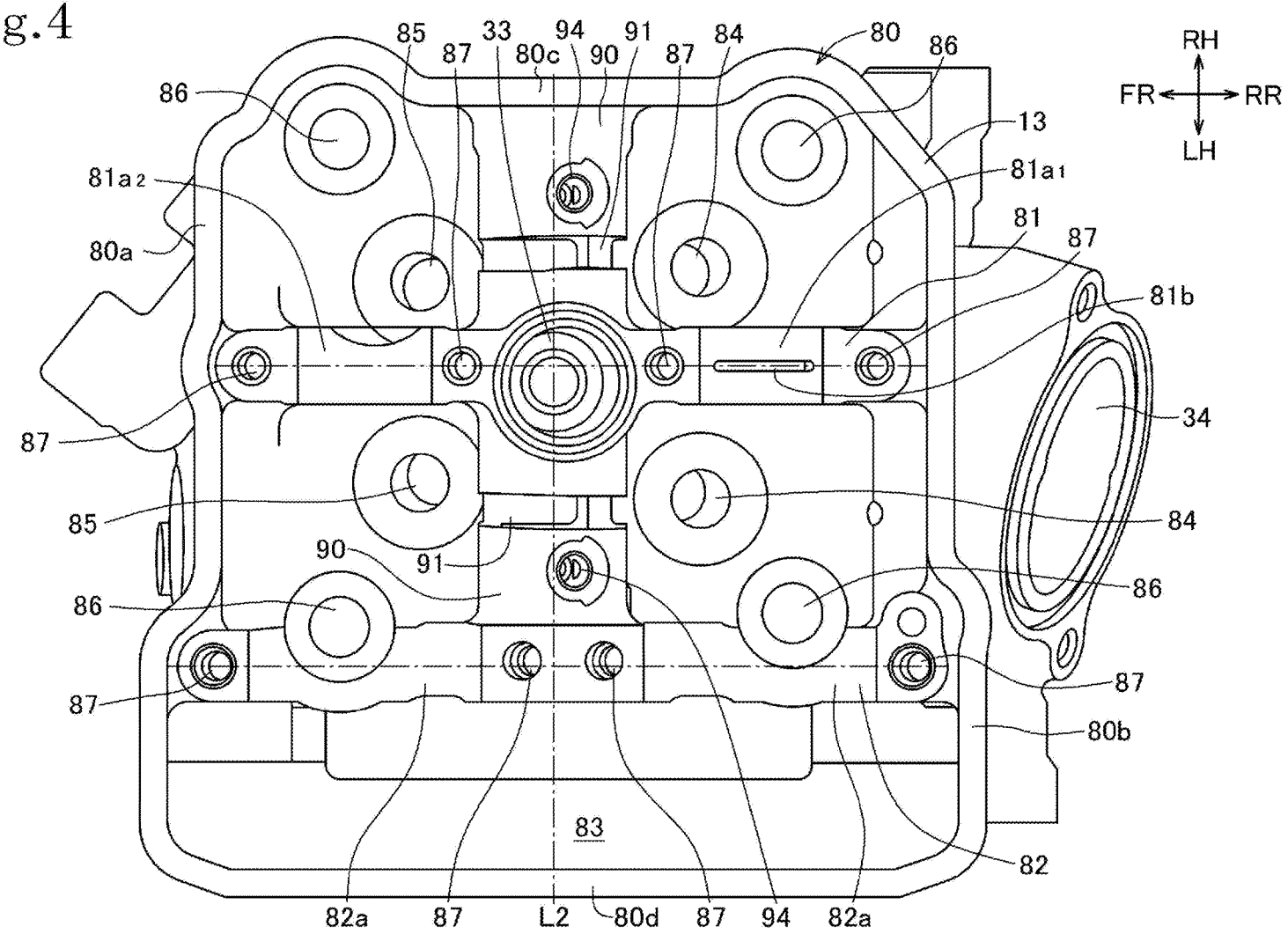
FIG. 4 is a top view of a cylinder head of the engine.

In the cylinder head 13, intake valve openings 31 and exhaust valve openings 32 are formed in a pair, respectively, and the intake valve opening 31 and the exhaust valve opening 32 open in the upper wall surface of the combustion chamber 30. As shown in FIG. 4, an ignition plug hole 33 opens in a central region surrounded by the intake valve opening 31 and the exhaust valve opening 32, and an ignition plug 29 (FIG. 5) is inserted in the ignition plug hole 33. As indicated in FIG. 3, the intake valve opening 31 and the exhaust valve opening 32 communicate with an intake port 34 and an exhaust port 35, respectively, the intake port 34 and the exhaust port 35 being formed in the cylinder head 13.

The intake port 34 is formed so as to gently curve from the intake valve opening 31 rearward and to the left, and an intake pipe (not illustrated) is attached to the intake port 34. The exhaust port 35 is formed so as to curve from the exhaust valve opening 32 forward and to the right, and an exhaust pipe 16 is connected to the exhaust port 35 as shown in FIG. 1.

The internal combustion engine 10 is equipped with a pair of intake valves 40 and a pair of exhaust valves 41, the intake valve 40 opening/closing the path of the intake flow from the intake port 34 into the combustion chamber 30, and the exhaust valve 41 opening/closing the path of the exhaust flow from the combustion chamber 30 to an exhaust port 38. The intake valve 40 for opening/closing the intake valve opening 31 is disposed in the intake valve opening 31, and the exhaust valve 41 for opening/closing the exhaust valve opening 32 is disposed in the exhaust valve opening 32. The ignition plug 29 is arranged so as to face the central region of the combustion chamber 30 (refer to FIG. 5).

Figure 5:
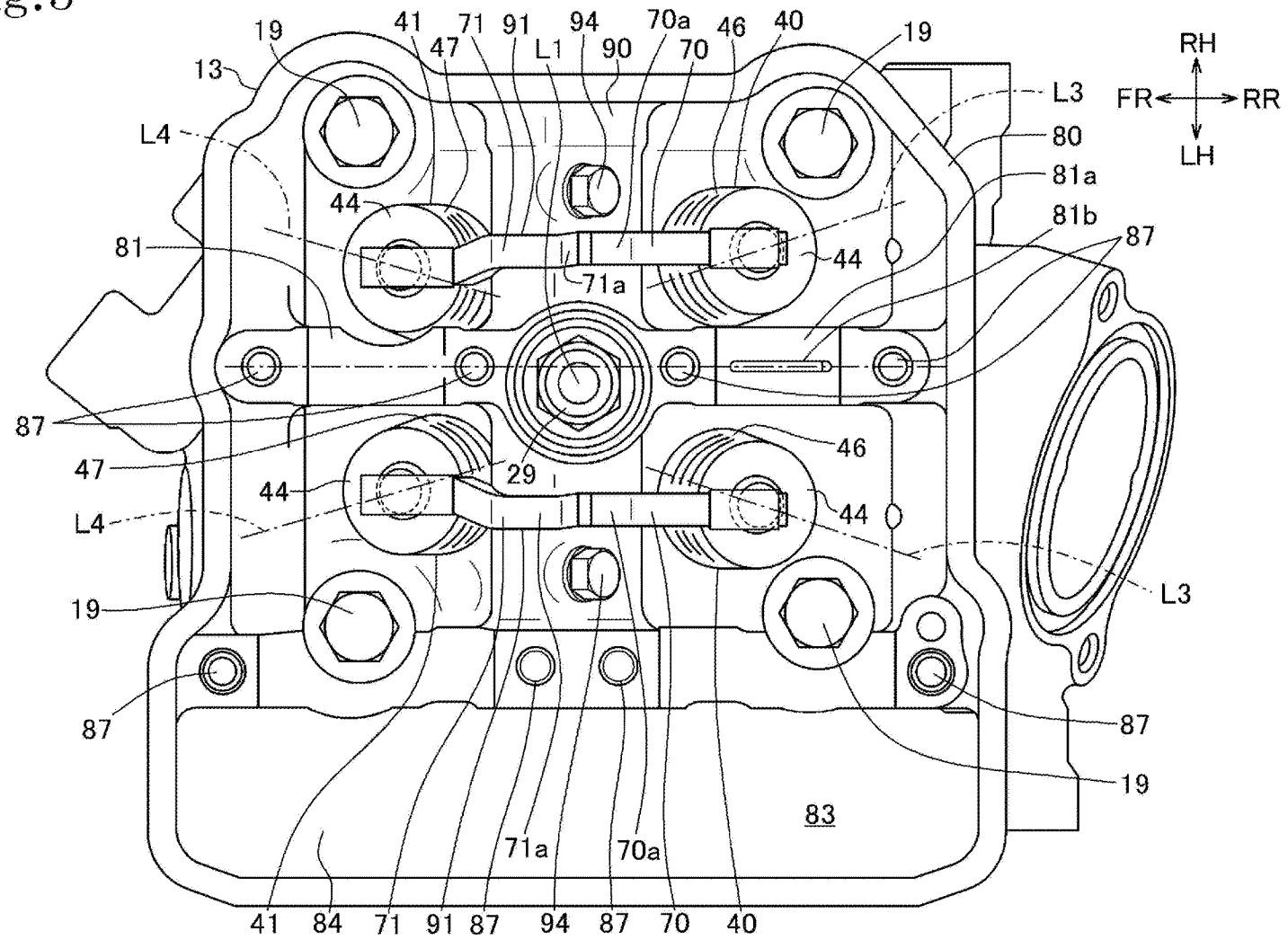
FIG. 5 is a view when the cylinder head attached with intake rocker arms and exhaust rocker arms are viewed in the direction of attachment of a cylinder head cover.
Figure 13:
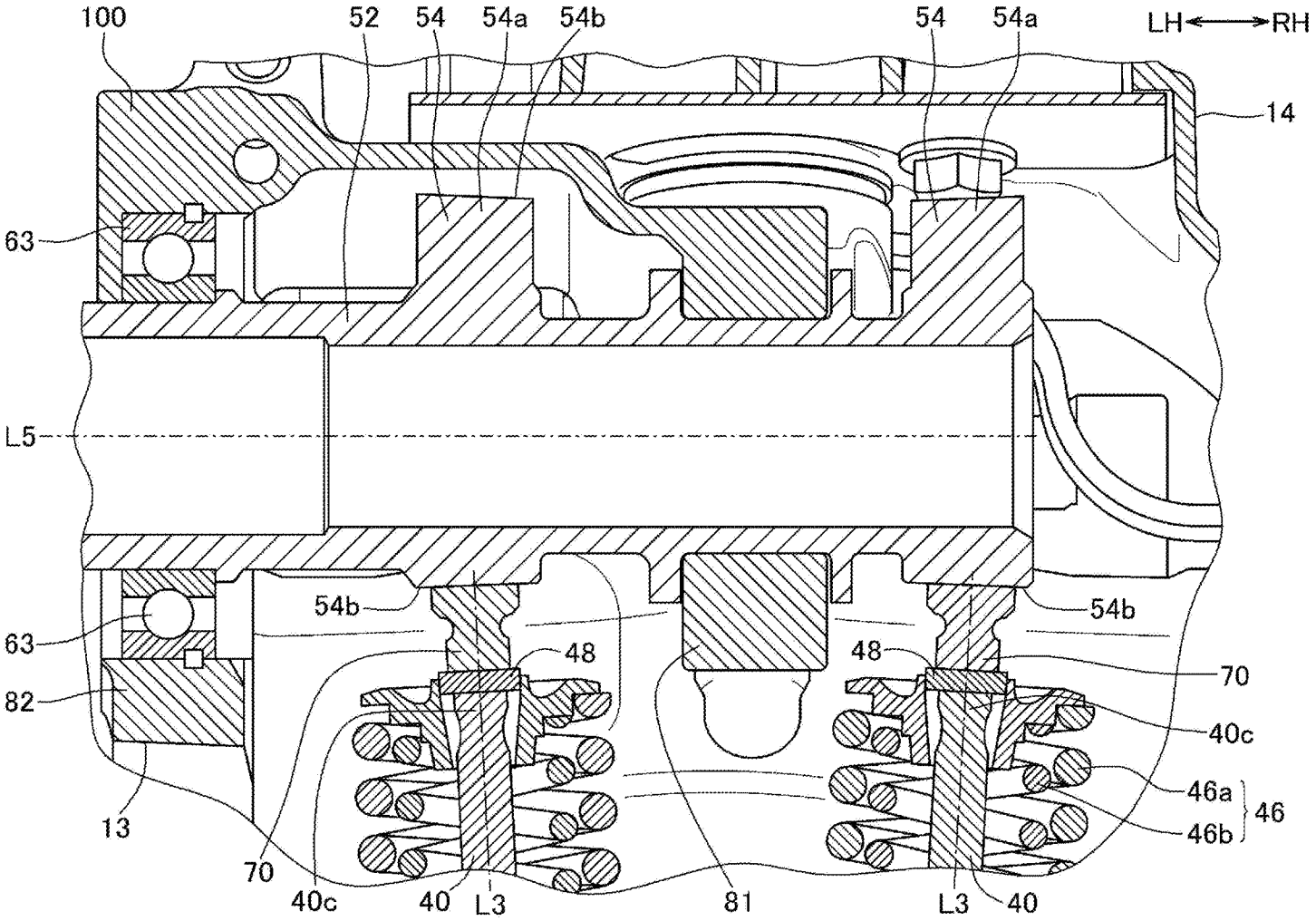
FIG. 13 is an enlarged cross-sectional view of an essential part of the engine when the engine is cut by a plane that passes an intake cam axis and an intake valve axis.

As shown in FIGS. 3, 5 and 13, these intake valves 40 and exhaust valves 41 are disposed in a radially directed arrangement so as to extend three-dimensionally about a center axis L1 of the cylinder bore 18 (cylinder axis) and in a direction away from the combustion chamber 30. As shown in FIG. 3, the intake valve 40 and the exhaust valve 41 are inserted in valve guides 43, respectively, in a slidable manner, the valve guides 43 being pressed into the cylinder head 13. The intake valve 40 and the exhaust valve 41 are constantly urged to valve closing directions by the forces of an intake-side spring 46 and an exhaust-side spring 47, respectively. The intake-side spring 46 and the exhaust-side spring 47 are disposed under resilient compression between upper retainers 44 and lower retainers 45, respectively. The intake-side spring 46 consists of two springs of a first spring 46*a* and a second spring 46*b*, and is set to have a spring force larger than that of the exhaust-side spring 47.

A valve gear or valve drive mechanism 50 for executing an opening/closing motion of the intake valves 40 and the exhaust valves 41 is arranged in a space formed between the cylinder head 13 and the cylinder head cover 14 as shown in FIG. 3. The rocker arm system of DOHC-type is employed for the valve drive mechanism 50. The intake valves 40 and the exhaust valves 41 are driven by the valve drive mechanism 50, and open/close the intake ports 34 and the exhaust ports 35 in synchronized timings with the engine speed. The intake ports 34 and the exhaust ports 35 open to the combustion chamber 30.

Figure 14:
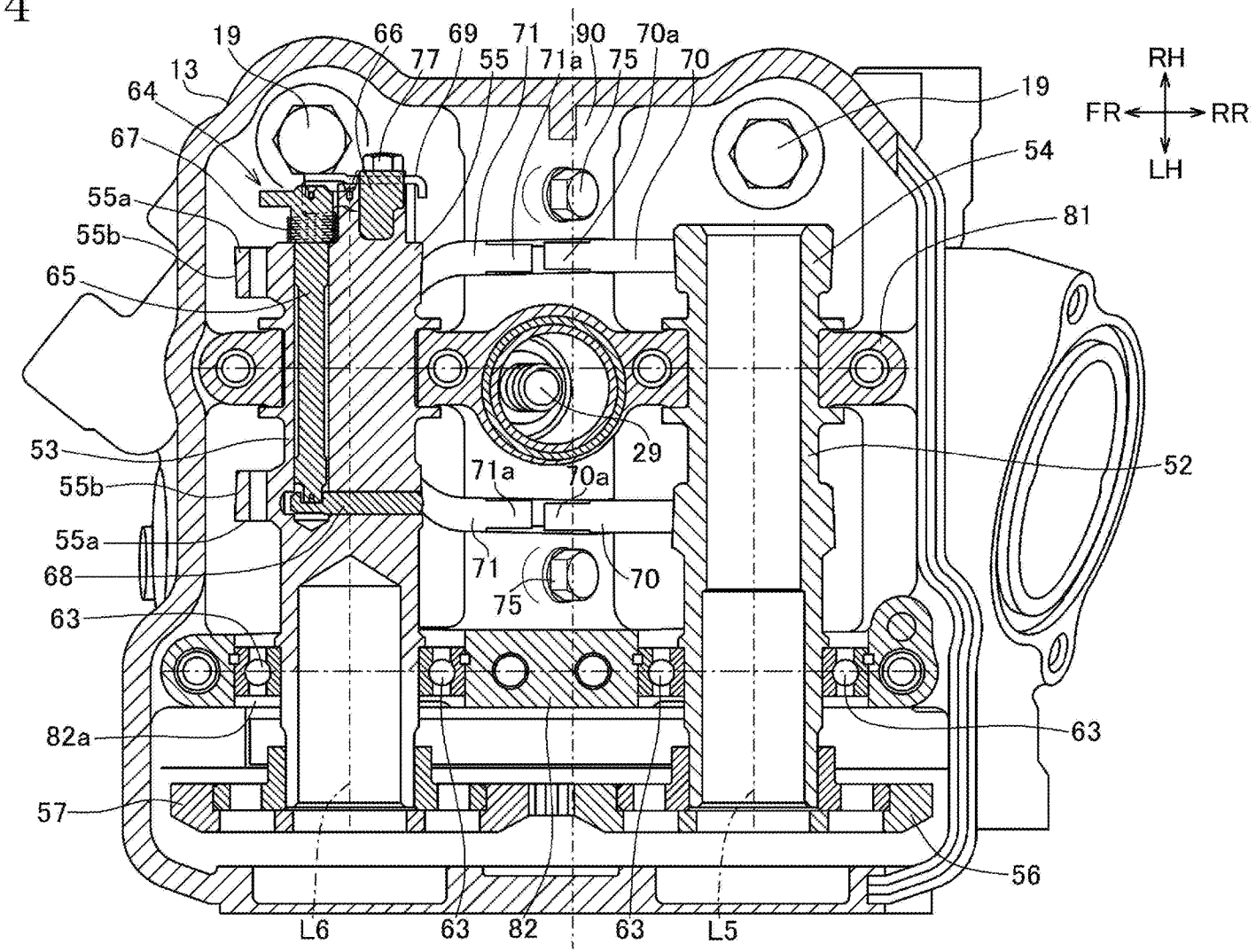
FIG. 14 is a view of the cylinder head when the cylinder head is attached with an intake camshaft and an exhaust camshaft and is cut along the intake cam axis and an exhaust cam axis.

As shown in FIG. 3, the valve drive mechanism 50 includes an intake camshaft 52 and an exhaust camshaft 53. The intake camshaft 52 has a pair of intake cams 54, which cooperate with the pair of the intake valves 40, respectively. The exhaust camshaft 53 has a pair of exhaust cams 55, which cooperate with the pair of the exhaust valves 41, respectively. As shown in FIGS. 2 and 14, an intake cam shaft gear 56 is provided on the intake camshaft 52 so as to be rotated therewith, and an exhaust cam shaft gear 57 is provided on the exhaust camshaft 53 so as to be rotated therewith. A driven gear 61 is engaged with these intake cam shaft gear 56 and exhaust cam shaft gear 57, and an endless timing chain 62 is stretched between the driven gear 61 and a driving gear 60 on the crankshaft 20, so that the driving gear 60 is rotated by the crankshaft 20. Thus, the intake camshaft 52 and the exhaust camshaft 53 are rotated by the rotation of the crankshaft 20 in a synchronized manner.

As shown in FIG. 3, intake rocker arms 70 are provided between cam surfaces 54*b* of the intake cams 54 and shaft end portions 40*c* of the intake valves 40, respectively. The shaft end portions 40*c* of the intake valves 40 are pressed by distal ends of the intake rocker arms 70 through cotters 48 according to the shape of cam crests 54*a* of the intake cams 54 in relation to the rotation of the intake camshaft 52, so that the intake valves 40 are opened/closed at predetermined timings.

Exhaust rocker arms 71 are provided between cam surfaces 55*b* of the exhaust cams 55 and shaft end portions 41*c* of the exhaust valves 41, respectively. The shaft end portions 41*c* of the exhaust valves 41 are pressed by distal ends of the exhaust rocker arms 71 through cotters 48 according to the shape of cam crests 55*a* of the exhaust cams 55 in relation to the rotation of the exhaust camshaft 53, so that the exhaust valves 41 are opened/closed at predetermined timings.

Figure 19:
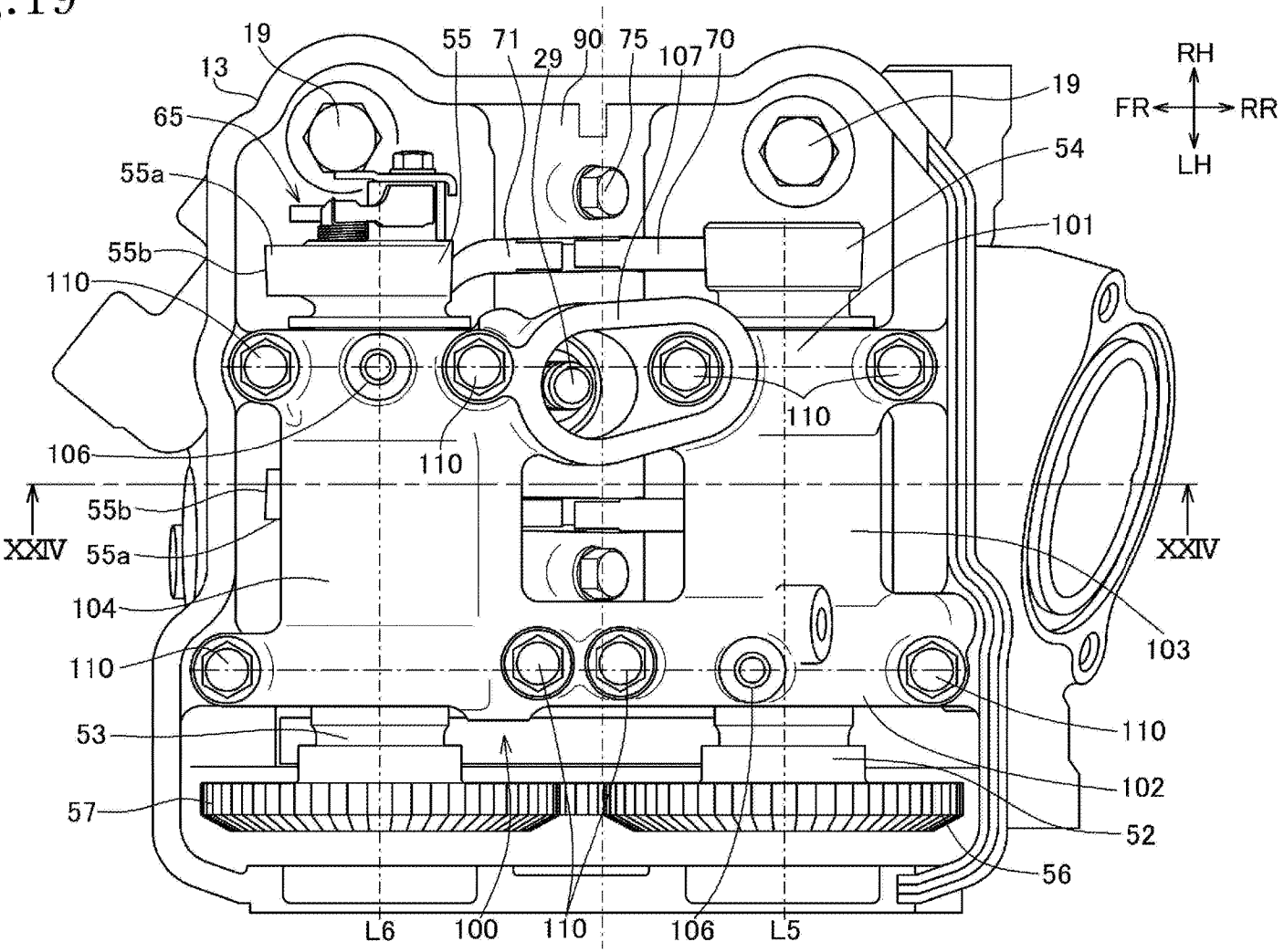
FIG. 19 is a top view of the cylinder head attached with a camshaft holder.
Figure 24:
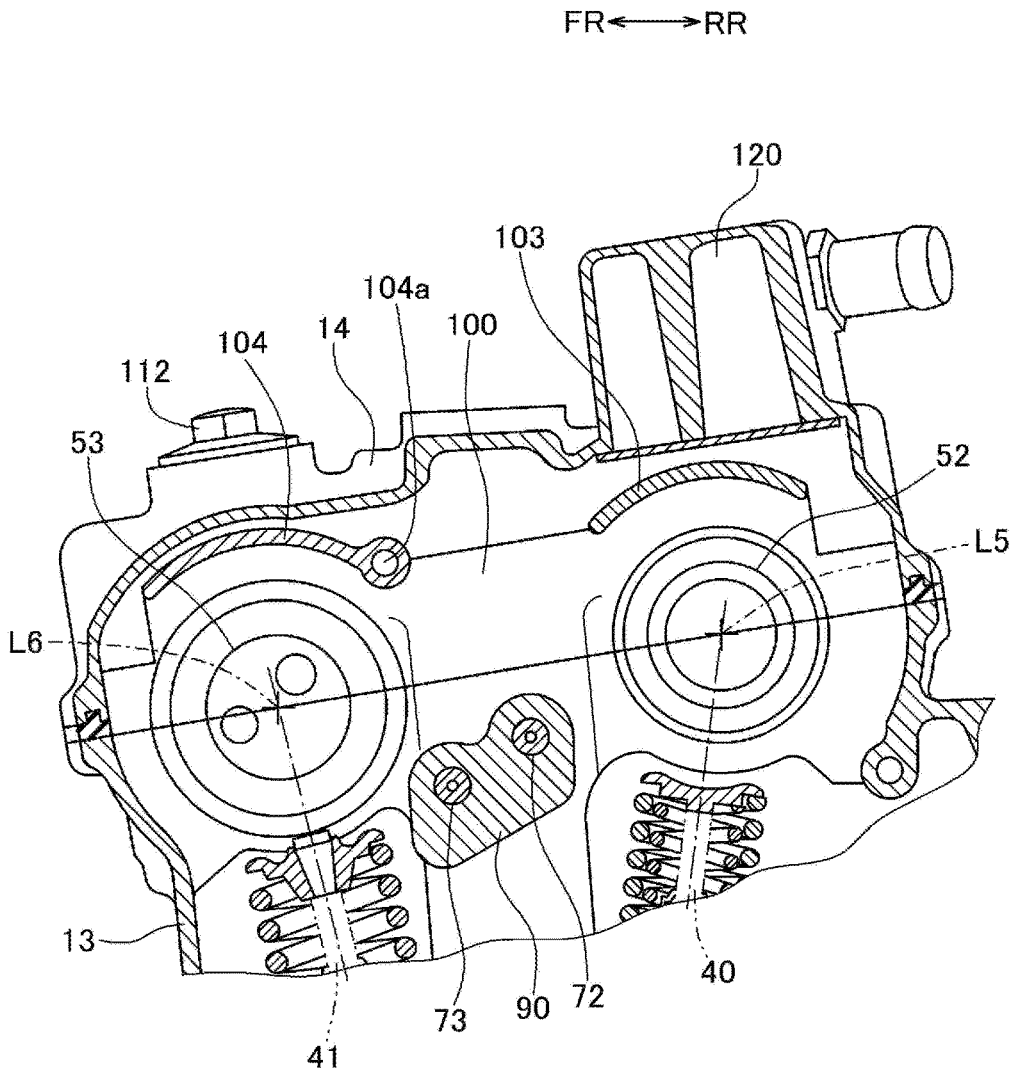
FIG. 24 is a vertical sectional view of an essential part of the engine when the cylinder head cover is attached to the cylinder head of FIG. 19 and the engine is cut along the line XXIV-XXIV of FIG. 19.

As shown in FIGS. 19 and 24, the intake camshaft 52, the exhaust camshaft 53, the intake rocker arms 70, and the exhaust rocker arms 71 are rotatably supported by the cylinder head 13 and a camshaft holder 100 fixed to the cylinder head 13.

FIG. 4 is a view of the cylinder head 13 as viewed from the direction orthogonal to the top surface of the cylinder head 13. The cylinder head 13 includes a peripheral wall portion 80, to which the cylinder head cover 14 is fixedly joined. The peripheral wall portion 80 is made up of a front wall portion 80*a*, a rear wall portion 80*b*, a right wall portion 80*c*, and a left wall portion 80*d*. A first camshaft support portion 81 and a second camshaft support portion 82 are arranged so as to connect the front wall portion 80*a* and the rear wall portion 80*b*, and to extend orthogonal to a crank shaft axis L2. Out of the first and second camshaft support portions 81 and 82, the first camshaft support portion 81 is positioned on the right side, and the second camshaft support portion 82 is positioned on the left side. As shown in FIGS. 4 and 14, the first camshaft support portion 81 includes bearing half sections 81*a*, which directly support the intake camshaft 52 and the exhaust camshaft 53, respectively. The second camshaft support portion 82 includes bearing half sections 82*a*, which support the intake camshaft 52 and the exhaust camshaft 53 through bearings 63, respectively.

As shown in FIGS. 2 and 3, the cylinder body 12 and the cylinder head 13 are joined on a joining surface P1, while the first and second camshaft support portions 81 and 82 and the camshaft holder 100 are joined on a joining surface P2. On the side of the exhaust port 35, namely the front side, the joining surface P2 of the cylinder head 13 is set at a distance $D_1$ from the joining surface P1, while on the side of the intake port 34, namely the rear side, the joining surface P2 of the cylinder head 13 is set at a distance $D_2$ from the joining surface P1. The distance $D_2$ is greater than the distance $D_1$. As a result, the joining surface P2 is formed to slope relative to the joining surface P1, in such a manner that the joining surface P2 approaches the joining surface P1 as the joining surface P2 extends from the rear side to the front side, i.e., to the side of the exhaust port 35.

As shown in FIG. 4, a rocker arm support boss portion 90 extends in the cylinder head 13, so as to be orthogonal to the first and second camshaft support portions 81 and 82 and to be parallel to the crank shaft axis L2, as viewed from the top of the cylinder head 13. The rocker arm support boss portion 90 pivotally supports the intake rocker arms 70 and the exhaust rocker arms 71. The rocker arm support boss portion 88 extends to connect the right wall portion 80*c* and the second camshaft support portion 82, and is orthogonal to the first camshaft support portion 81. The ignition plug hole 33 is located at an intermediate portion of the rocker arm support boss portion 90. A space is formed by the second camshaft support portion 82, a part of the front wall portion 80*a*, the left wall portion 80*d*, and a part of the rear wall portion 80*b*, which space serves as a cam chain chamber 83.

Thus, the walls around the upper part of the ignition plug hole 33 of the cylinder head 13 extend radially about the ignition plug hole 33 in four directions and are connected also to the second camshaft support portion 82 functioning as a wall of the inner side of the cam chain chamber 83 of the cylinder head 13. Therefore the construction of the cylinder head 13 is rigid.

In the four spaces of the cylinder head 13, separated by the first camshaft support portion 81 and the rocker arm support boss portion 90, are formed intake valve insertion holes 84, exhaust valve insertion holes 85, and stud bolt insertion holes 86 are formed respectively.

In the first camshaft support portion 81 and the second camshaft support portion 82, as shown in FIG. 4, camshaft holder fastening holes 87 for fastening the camshaft holder 100 are formed on both sides of each of the bearing half sections 81*a* and the bearing half sections 82*a*. The bearing half sections 81*a* of the first camshaft support portion 81 include a first bearing half section 81$a_1$ on the intake side and a first bearing half section 81$a_2$ on the exhaust side, and an oil feeding hole 81*b* is provided in the first bearing half section 81$a_1$ on the intake side. Oil under pressure is supplied from an oil pump (not illustrated) to the first bearing half section 81$a_1$ through an oil passage (not illustrated) inside the cylinder body 12 and the cylinder head 13.

As shown in FIG. 14, the intake camshaft 52 and the exhaust camshaft 53 are supported by the first camshaft support portion 81 and the second camshaft support portion 82. As FIG. 5 shows, intake valve axes L3 of the intake valves 40 and exhaust valve axes L4 of the exhaust valves 41 extend from the combustion chamber 30 in radial directions with respect to the cylinder axis L1 in a three-dimensional manner around the cylinder axis L1. Here, as shown in FIG. 13, the cam surface 54*b* of each of the intake cams 54 is formed such that the height of the cam surface 54*b* changes lower on the side near to the ignition plug 29 and higher on the side far from the ignition plug 29 to cause the cam surface 54*b* of each intake cam 54 to press the shaft end portion 40*c* of the associated intake valve 40 in the direction of an intake valve axis L3, whereby the cam surface 54*b* of each intake cam 54 is formed to be inclined relative to an intake cam axis L5 of the intake camshaft 52. In a similar manner, as shown in FIG. 14, the cam surface 55*b* of each of the exhaust cams 55 on the exhaust camshaft 53 is formed such that the height of the cam surface 55*b* changes lower on the side near to the ignition plug 29 and higher on the side far from the ignition plug 29, and the cam surface 54*b* of each exhaust cam 55 is formed to be inclined relative to an exhaust cam axis L6 of the exhaust camshaft 53.

As shown in FIG. 3, each intake rocker arm 70 and each exhaust rocker arm 71 respectively include pivotal support base portions 70*a* and 71*a*, swing arm sections 70*b* and 71*b*, and pressing portions 70*c* and 71*c*. The pivotal support base portions 70*a* and 71*a* are pivotally supported by rocker arm support pins 72 and 73 to be described, to enable the intake and exhaust rocker arms 70 and 71 to swing. The swing arms 70*b* and 71*b* extend from the pivotal support base portions 70*a* and 71*a*, and pressing portions 70*c* and 71*c* are positioned at the distal ends of the swing arms 70*b* and 71*b* to press the intake valve 40 and the exhaust valve 41, respectively.

As shown in FIGS. 6 to 9, support pin insertion holes 92 for the intake rocker arms 70 and support pin insertion holes 93 for the exhaust rocker arm 71 are formed in the rocker arm support boss portion 90 arranged in the cylinder head 13. An intake rocker arm support pin 72 as an intake rocker arm support member is inserted in the intake rocker arm support pin insertion hole 92. Thus, each of the intake rocker arm support member rotatably supports each of the intake rocker arms 70. An exhaust rocker arm support pin 73 as an exhaust rocker arm support member is inserted in the exhaust rocker arm support pin insertion hole 93, and each of the exhaust rocker arm support member rotatably supports each of the exhaust rocker arms 71.

Figure 6:
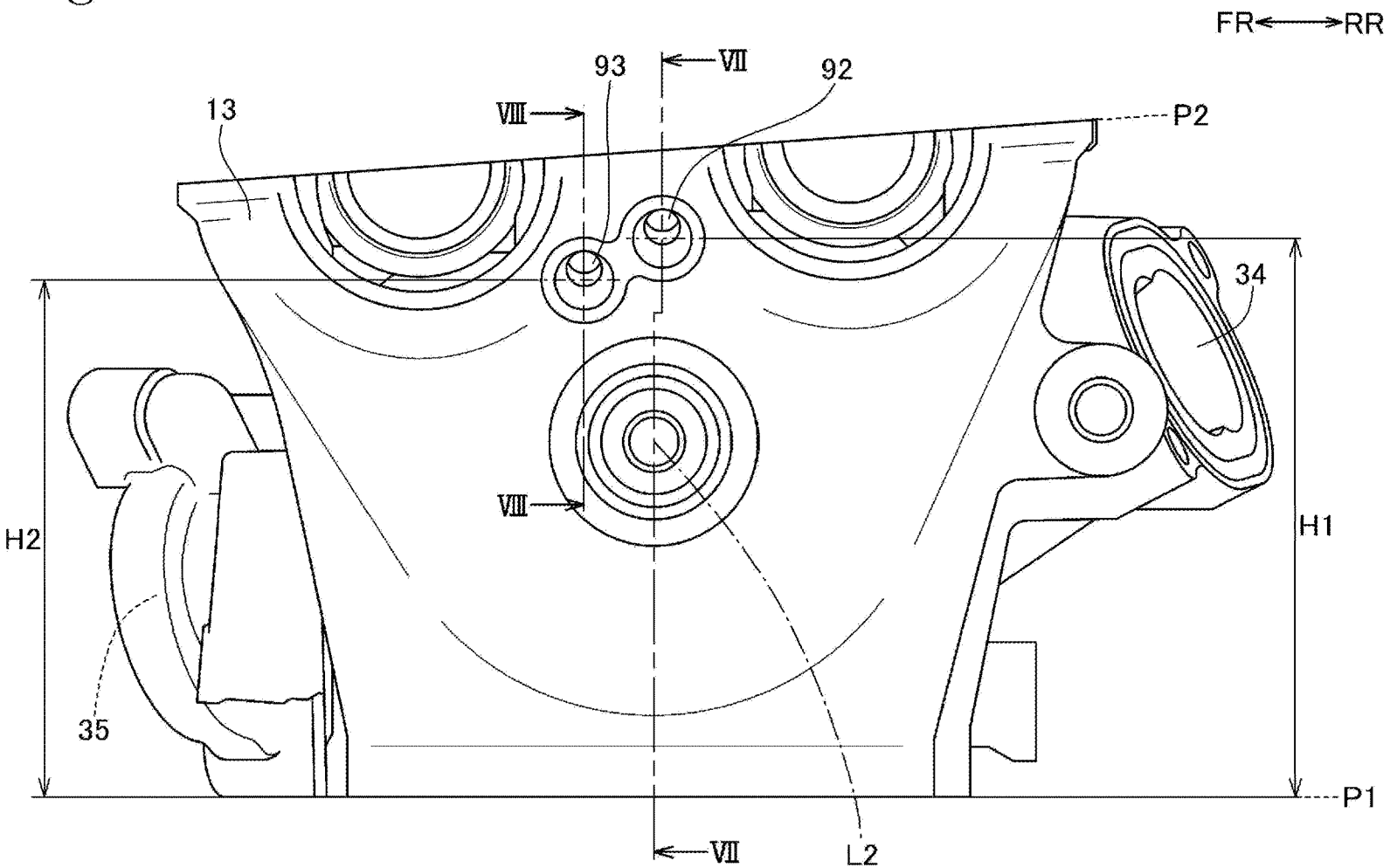
FIG. 6 is a left side view of the cylinder head.

As shown in FIG. 6, which is a view of the side surface of the cylinder head 13 as viewed in the direction of the axis L2 of the crankshaft 20, the intake rocker arm support pin insertion hole 92 is arranged at a distance of H1 from the joining surface P1 of the cylinder body 12 and the cylinder head 13, and the exhaust rocker arm support pin insertion hole 93 is arranged at a distance of H2 from the joining surface P1. The distance H1 is set to be greater than the distance H2.

As viewed in the crank axis L2 of the crankshaft 20, it is configured such that the exhaust rocker arm support pin insertion holes 93 are formed on the side where the distance between the joining surface P2 and the joining surface P1 is shorter, the joining surface P2 joining the first and second camshaft support portions 81 and 82 and the camshaft holder 100, the joining surface P1 joining the cylinder head 13 and the cylinder body 12. The exhaust rocker arm support pin 73 is inserted in each exhaust rocker arm support pin insertion hole 93. The intake rocker arm support pin insertion holes 92 are formed on the side where the distance between the joining surface P2 and the joining surface P1 is longer, and the intake rocker arm support pin 72 is inserted to each intake rocker arm support pin insertion hole 92.

Figure 7:
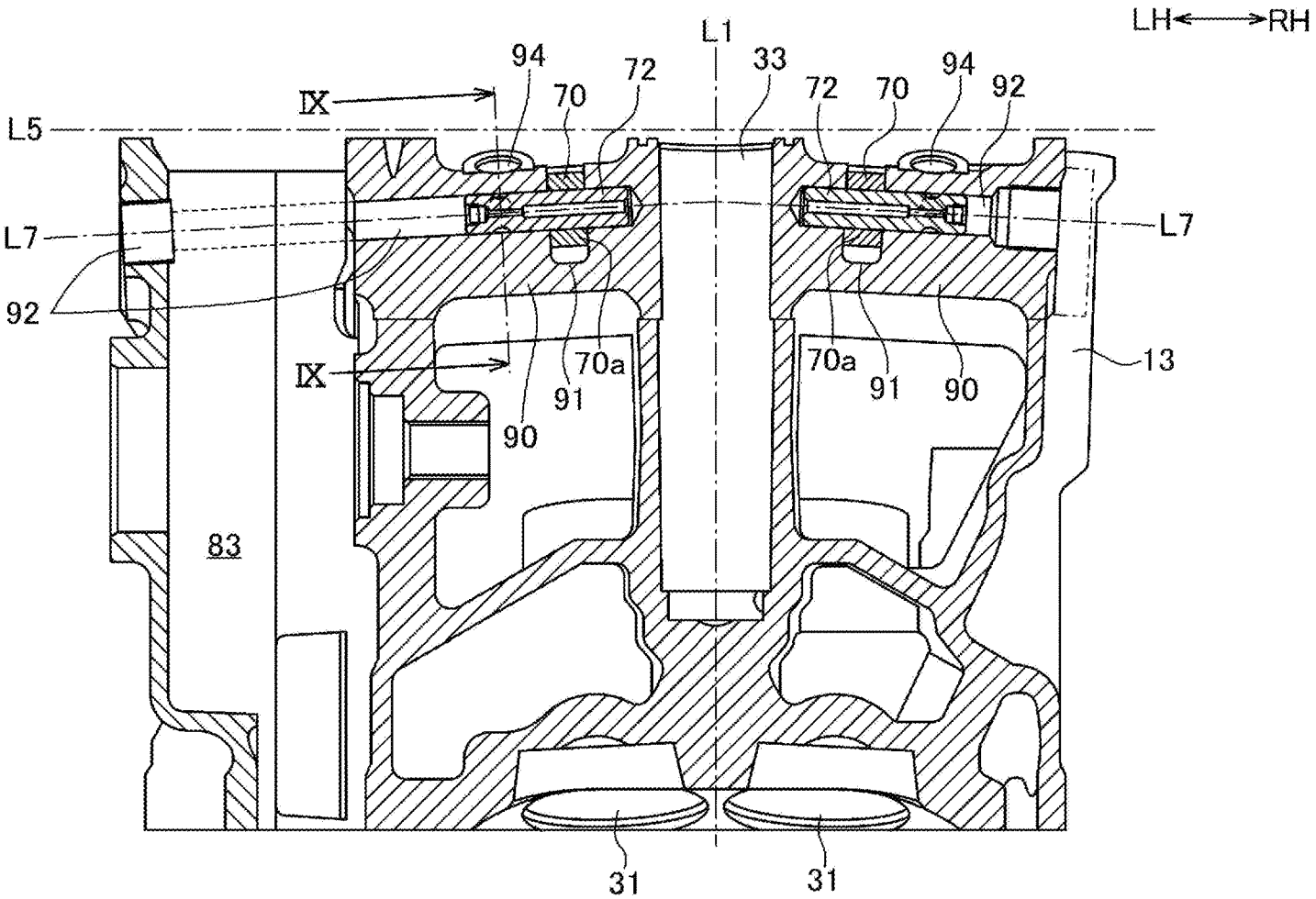
FIG. 7 is a cross-sectional view taken along the line VII-VII of FIG. 6.

The intake rocker arm support pin insertion holes 92 are formed in the cylinder head 13 in such shape as shown in FIG. 7, which is a section by a plane parallel to the crank shaft axis L2. As shown in FIG. 13, the cam surfaces 54*b* of the intake cams 54 are formed to incline downward toward the combustion chamber relative to the intake cam axis L5 of the intake camshaft 52. More specifically, the cam surfaces 54*b* are formed such that the heights of the cam surfaces 54*b* change lower on the mutually confronting sides (inner sides) and higher on the mutually far sides (outer sides). Here, as shown in FIG. 7, each of the intake rocker arm support pin insertion holes 92 is formed so as to extend at the same inclination angle as the inclination angle of the associated cam surface 54*b* relative to the intake cam axis L5 of the intake camshaft 52, so that the inner sides of the intake rocker arm support pin insertion holes 92 are at higher positions and the outer sides are at lower positions. Thus, the intake rocker arm support pin insertion holes 92 have their intake rocker arm axes L7 and is formed so that an intake rocker arm axis L7 are generally parallel to the corresponding cam surfaces 54*b*.

Figure 8:
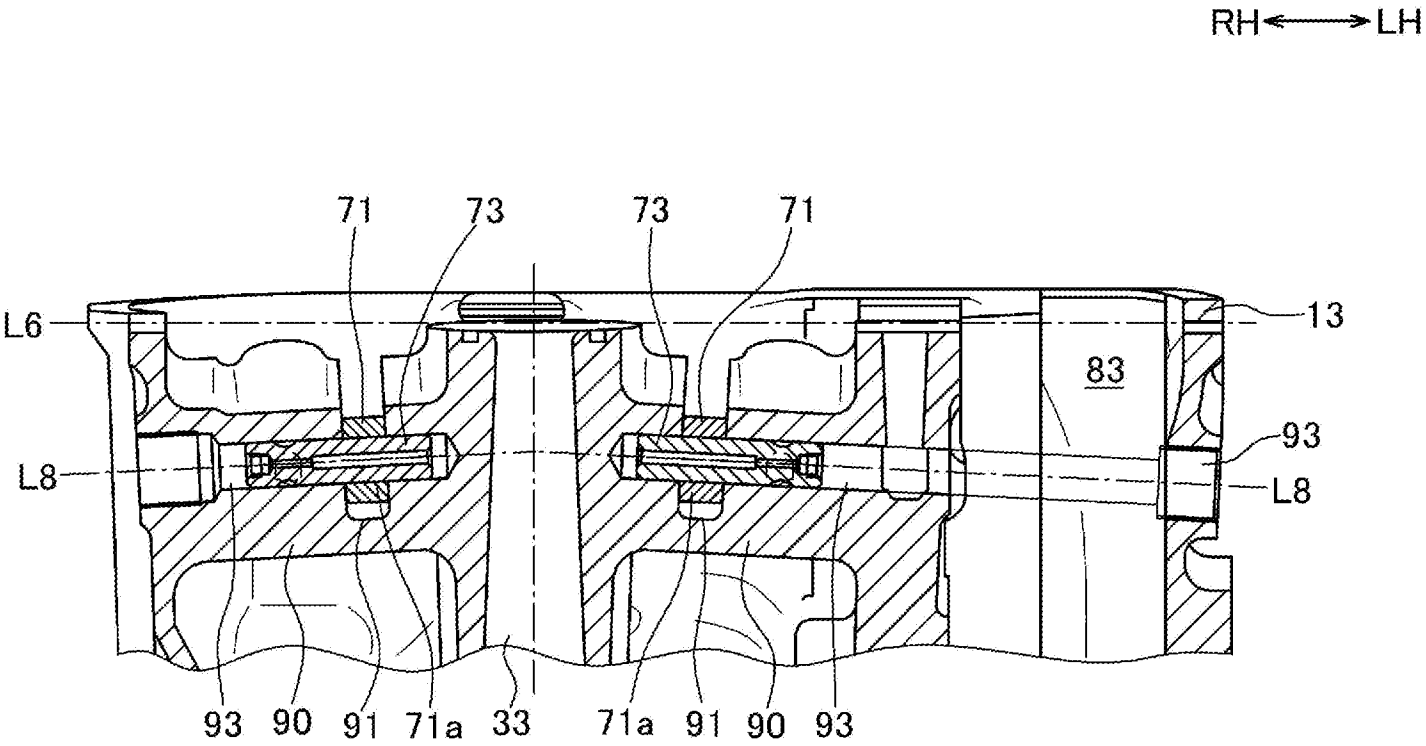
FIG. 8 is a cross-sectional view taken along the line VIII-VIII of FIG. 6.

The exhaust rocker arm support pin insertion holes 93 are formed in the cylinder head 13 in such shape as shown in FIG. 8, which is a section by a plane parallel to the crank shaft axis L2. As shown in FIG. 14, the cam surfaces 55*b* of the exhaust cams 55 are formed to incline downward toward the combustion chamber relative to the exhaust cam axis L6 of the exhaust camshaft 53. More specifically, the cam surfaces 55*b* are formed such that the heights of the cam surfaces 55*b* change lower on the mutually confronting sides (inner sides) and higher on the mutually far sides (outer sides). Here, as shown in FIG. 8, each of the exhaust rocker arm support pin insertion holes 93 is formed so as to extend at the same inclination angle as the inclination angle of the associated cam surface 55*b* relative to the exhaust cam axis L6 of the exhaust camshaft 53, so that the inner sides of the exhaust rocker arm support pin insertion holes 93 are at higher positions and the outer sides are at lower positions. Thus, the exhaust rocker arm support pin insertion holes 93 have their exhaust rocker arm axes L8 and is formed so that an exhaust rocker arm axis L8 are generally parallel to the corresponding cam surfaces 55*b*.

As shown in FIGS. 4, 5, 7 and 9, the top surface of the rocker arm support boss portion 90 of the cylinder head 13, has positioning grooves 91 formed in the surface of the rocker arm support boss portion 90, the positioning grooves 91 receiving and positioning the pivotal support base portions 70*a* of the intake rocker arms 70 and the pivotal support base portions 71*a* of the exhaust rocker arms 71.

As shown in FIG. 7, each intake rocker arm support pin 72 is inserted in the intake rocker arm support pin insertion hole 92, to pivotably support the pivotal support base portion 70*a* of the intake rocker arm 70, and the intake rocker arm support pin 72 is disposed so as to incline to the same side as the side to which the associated cam surface 54*b* inclines relative to the intake cam axis L5 of the intake camshaft 52.

As shown in FIG. 8, the exhaust rocker arm support pin 73 is inserted in the exhaust rocker arm support pin insertion hole 93, to pivotably support the pivotal support base portions 71*a* of the exhaust rocker arm 71. The exhaust rocker arm support pin 73 is disposed so as to incline to the same side as the side to which the associated cam surface 55*b* inclines relative to the exhaust cam axis L6 of the exhaust camshaft 53.

As shown in FIG. 3, the intake rocker arm support pin 72 and the exhaust rocker arm support pin 73 are disposed between the intake camshaft 52 and the exhaust camshaft 53 as viewed along the cylinder axis L1 (refer also to FIGS. 12 and 14), and the intake rocker arm 70 and the exhaust rocker arm 71 are disposed so as to extend from the inner side toward the outer side, the inner side being an area between the intake camshaft 52 and the exhaust camshaft 53. The intake rocker arm 70 and the exhaust rocker arm 71 are supported by the intake rocker arm support pin 72 and the exhaust rocker arm support pin 73, respectively. The pivotal support base portions 70*a* of the intake rocker arm 70 and the pivotal support base portions 71*a* of the exhaust rocker arm 71 are disposed so that the distances from the joining surface P1 are different, the joining surface P1 being a surface between the cylinder head 13 and the cylinder body 12. The pivotal support base portions 70*a* of the intake rocker arm 70 and the pivotal support base portions 71*a* of the exhaust rocker arm 71 are disposed so that the distance from a pivotal center C70 of the intake rocker arm 70 to the joining surface P1 is greater, by a distance d1, than the distance from a rotational center C71 of the exhaust rocker arm 71 to the joining surface P1.

Figure 10:
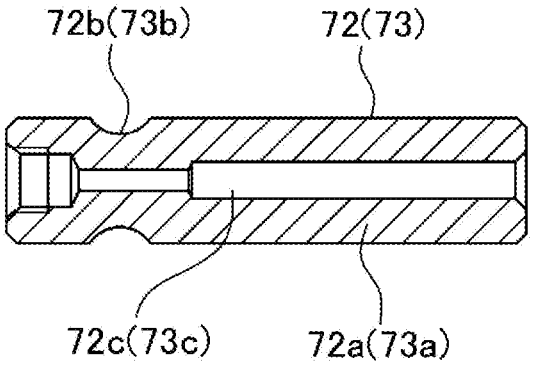
FIG. 10 is a vertical cross-sectional view of a rocker arm support pin.

As shown in FIG. 10, the same rocker arm support pins are used for the intake rocker arm support pin 72 and the exhaust rocker arm support pin 73 in the present embodiment. The rocker arm support pins has a shaft portion 72*a* (73*a*) of cylindrical shape, and a groove 72*b* (73*b*) with an arcuate cross section formed at a predetermined axial distance from one end of the shaft portion 72*a* (73*a*) to extend in the peripheral direction over the periphery. Inside the shaft portion 72*a* (73*a*), a hole 72*c* (73*c*) is formed such that one end thereof and the other end communicate with each other.

Figure 9:
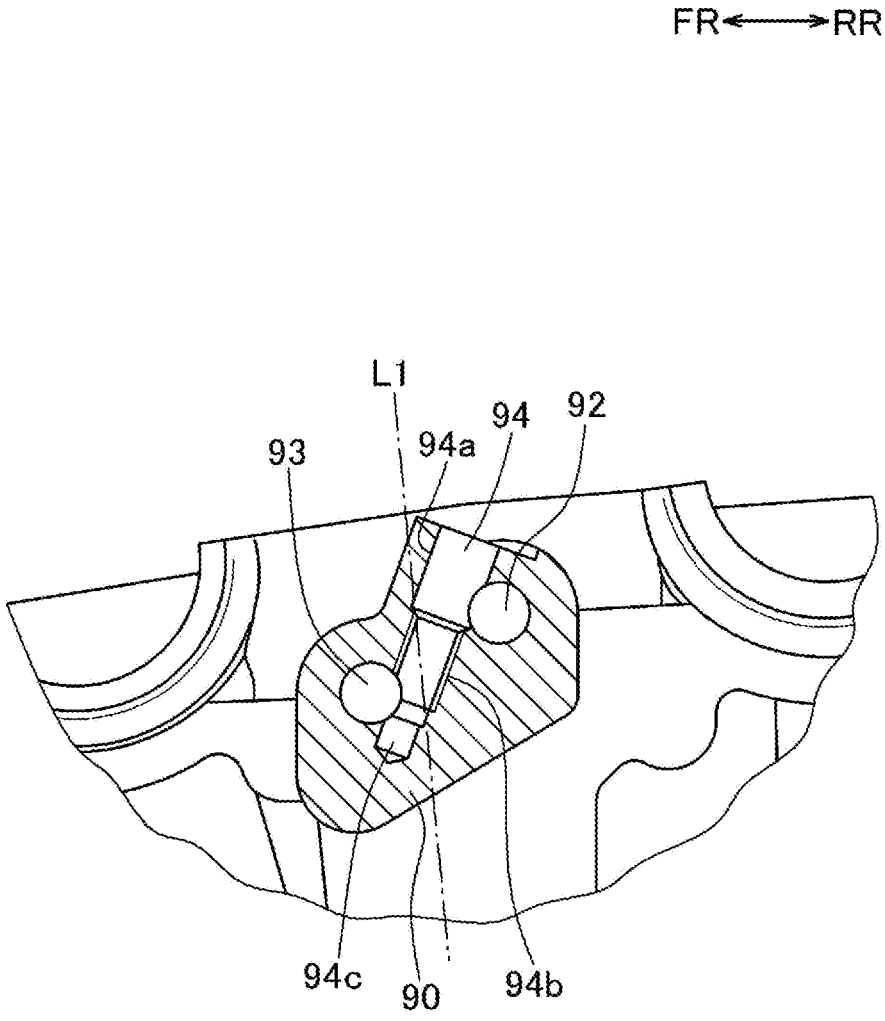
FIG. 9 is a cross-sectional view taken along the line IX-IX of FIG. 7.

As shown in FIG. 9, the rocker arm support boss portion 90 is formed with a slipping-off preventing member thread hole 94, and a slipping-off preventing member 75 is engaged with the slipping-off preventing member thread hole 94. The slipping-off preventing member 75 prevents slipping off of both the intake rocker arm support pin 72 and the exhaust rocker arm support pin 73. The intake rocker arm support pin 72 is inserted in the intake rocker arm support pin insertion hole 92, and the exhaust rocker arm support pin 73 is inserted in the exhaust rocker arm support pin insertion hole 93. The slipping-off preventing member thread hole 94 is formed so as to incline relative to the cylinder axis L1, and to incline downward from the intake side toward the exhaust side. The slipping-off preventing member thread hole 94 has its insertion side formed into a base portion 94*a* having an enlarged diameter, the distal end thereof is formed as a distal end portion 94*c* having a diameter smaller than that of the base portion 94*a*, and the middle part between the base portion 94*a* and the distal end portion 94*c* is formed into a middle thread portion 94*b*. The middle thread portion 94*b* has a diameter intermediate between that of the base portion 94*a* and that of the distal end portion 94*c*. Screw thread are formed in the middle thread portion 94*b*. The base portion 94*a* is made to communicate with the intake rocker arm support pin insertion hole 92 in the intake side, the intake side being the upper and right side in FIG. 9. The distal end portion 94*c* is positioned on the exhaust side, the exhaust side being the opposite side of the intake side. The distal end portion 94*c* is open to the exhaust rocker arm support pin insertion hole 93.

Figure 11:
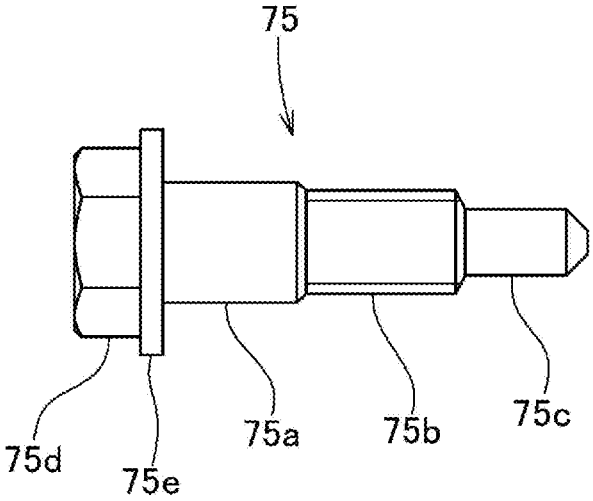
FIG. 11 is a side view of a slipping-off-preventing member.

As shown in FIG. 11, the slipping-off preventing member 75 in engagement with the slipping-off preventing member thread hole 94 has a base portion 75*a*, a tip portion 75*c*, and a middle thread portion 75*b*, the base portion 75*a* being inserted in the base portion 94*a* of the slipping-off preventing member thread hole 94. The tip portion 75*c* is of a reduced diameter compared to the base portion 75*a*, and the tip portion 75*c* is inserted in the distal end portion 94*c* of the slipping-off preventing member thread hole 94. The middle thread portion 75*b* between the base portion 75*a* and the tip portion 75*c*, is engaged with the middle thread portion 94*b* of the slipping-off preventing member thread hole 94 so as to be fixed to the cylinder head 13. The slipping-off preventing member 75 has a head portion 75*d* having a hexagonal shape and formed on the opposite side of the middle thread portion 75*b*, and a flange portion 75*e* formed between the head portion 75*d* and the base portion 75*a*.

The present embodiment is configured as described above, and the intake rocker arm 70 and the exhaust rocker arm 71 are installed in position as follows. The pivotal support base portion 70*a* of the intake rocker arm 70 on one side and the pivotal support base portion 71*a* of the exhaust rocker arm 71 on the same side are inserted in the associated positioning grooves 91 of the rocker arm support boss portion 90. Thereafter, the intake rocker arm support pin 72 is inserted into the intake rocker arm support pin insertion hole 92, and is passed through the pivotal support base portion 70*a* of the intake rocker arm 70. On the other hand, the exhaust rocker arm support pin 73 is inserted into the exhaust rocker arm support pin insertion hole 93, and is passed through the pivotal support base portion 71*a* of the exhaust rocker arm 71.

Figure 12:
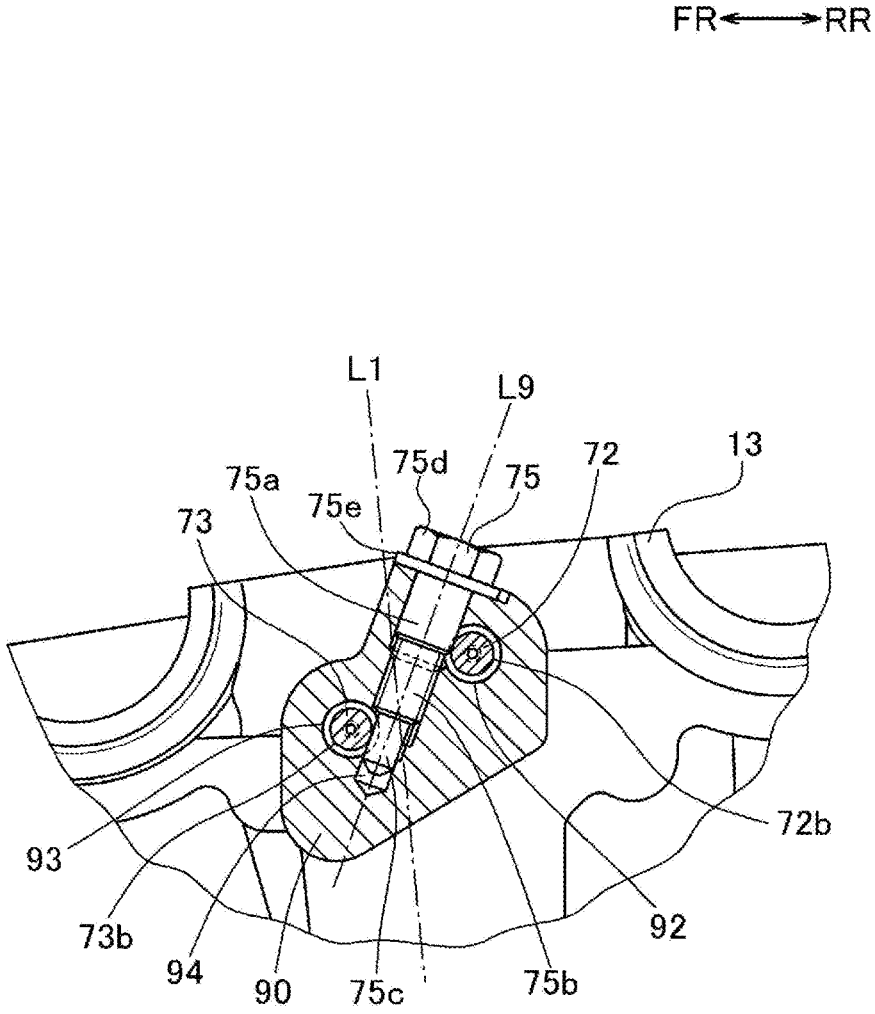
FIG. 12 is a vertical cross-sectional view of a vicinity of a rocker arm support boss portion in a state an intake rocker arm and an exhaust rocker arm are fixed by the slipping-off-preventing member.

Further, as shown in FIG. 12, the slipping-off preventing member 75 is engaged in the slipping-off preventing member thread hole 94 formed in the rocker arm support boss portion 90. The slipping-off preventing member 75 is engaged with the cylinder head 13 with an axis L9 of the slipping-off preventing member 75 inclining relative to the cylinder axis L1. The base portion 75*a* of the slipping-off preventing member 75 is made to abut on the portion of the groove 72*b* of the intake rocker arm support pin 72, and the intake rocker arm support pin 72 is positioned below the slipping-off preventing member axis L9 and is prevented from slipping off. Meanwhile, the tip portion 75*c* of the slipping-off preventing member 75 is made to abut on the groove portion 73*b* of the exhaust rocker arm support pin 73, and the exhaust rocker arm support pin 73 is positioned above the slipping-off preventing member axis L9 and is prevented from slipping off. Thus, the intake rocker arm support pin 72 and the exhaust rocker arm support pin 73 are prevented from slipping off by the same slipping-off preventing member 75. As shown in FIGS. 3, 7 and 8, the intake rocker arm 70 is pivotally supported by the cylinder head 13 through the intake rocker arm support pin 72, and the exhaust rocker arm 71 is pivotally supported by the cylinder head 13 through the exhaust rocker arm support pin 73.

After the intake rocker arm 70 and the exhaust rocker arm 71 have been attached to the cylinder head 13, the intake camshaft 52 and the exhaust camshaft 53 are mounted on the cylinder head 13 as shown in FIG. 14, the camshaft holder 100 is attached to the top surface of the cylinder head 13 as shown in FIG. 19, and the intake camshaft 52 and the exhaust camshaft 53 are rotatably supported by both the cylinder head 13 and the camshaft holder 100.

Figure 20:
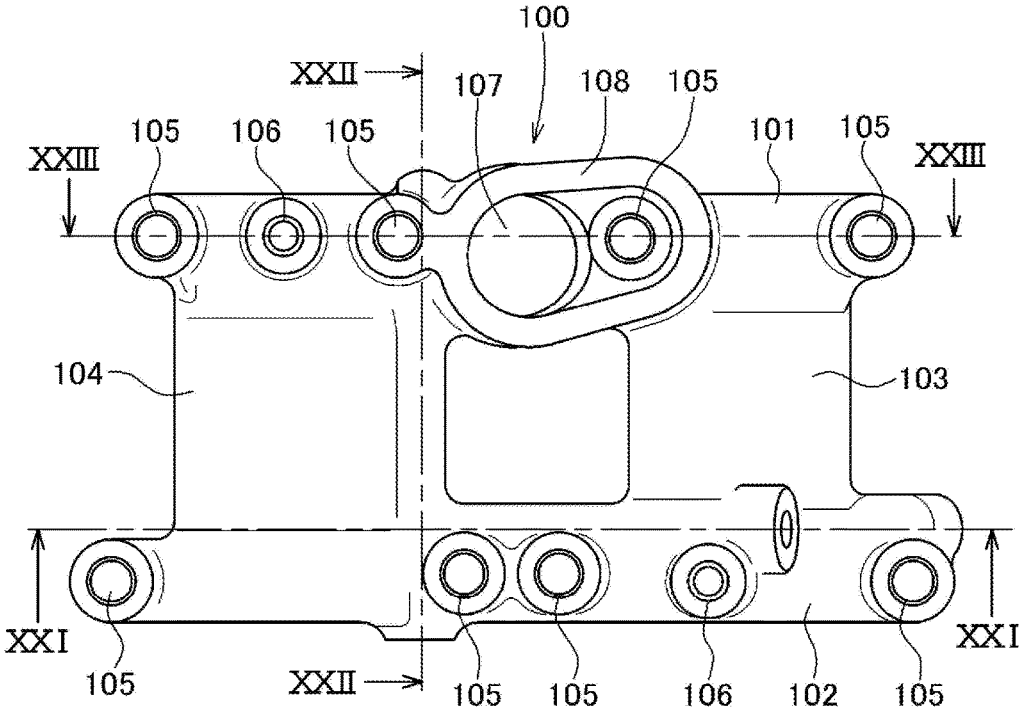
FIG. 20 is a top view of the single body of a camshaft holder.
Figure 21:
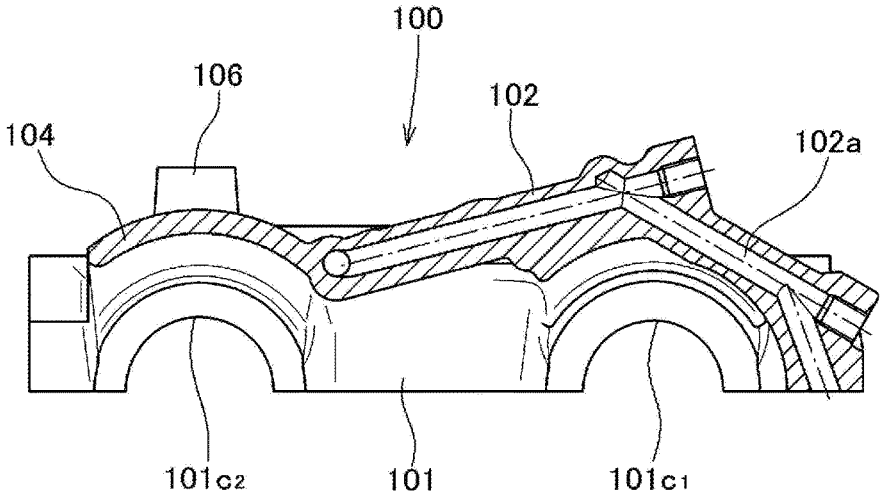
FIG. 21 is a sectional view taken along the line XXI-XXI of FIG. 20.

FIGS. 20 to 24 show the camshaft holder 100. The camshaft holder 100 includes a first support portion 101, a second support portion 102, an intake side connecting portion 103, and an exhaust side connecting portion 104. The first support portion 101 is made to abut on the first camshaft support portion 81 of the cylinder head 13. As illustrated in FIG. 21, a bearing portion 101*c* (a bearing 101$c_1$ for supporting the intake camshaft 52, a bearing 101$c_2$ for supporting the exhaust camshaft 53) is formed in the first support portion 101. The second support portion 102 is made to abut on the second camshaft support portion 82, and a similar bearing portion (not illustrated) is formed in the second support portion 102. The intake side connecting portion 103 connects the first support portion 101 and the second support portion 102 in the intake side. The exhaust side connecting portion 104 connects the first support portion 101 and the second support portion 102 in the exhaust side. The first support portion 101 and the second support portion 102 of the camshaft holder 100 are fixedly attached to the first camshaft support portion 81 and the second camshaft support portion 82 of the cylinder head 13, respectively, and the intake camshaft 52 and the exhaust camshaft 53 are rotatably supported by the first camshaft support portion 81 and the second camshaft support portion 82 of the cylinder head 13, respectively.

As shown in FIG. 20 the first support portion 101 and the second support portion 102 are formed, at positions respectively corresponding to the camshaft holder fastening holes 87 of the cylinder head 13, with eight bolt insertion holes 105, and bolts 110 are passed through the bolt insertion holes 105 into the camshaft holder fastening holes 87 of the cylinder head 13, so that the camshaft holder 100 is fixed to the cylinder head 13. Also, one bolt hole 106 is provided in each of the first support portion 101 and the second support portion 102 of the camshaft holder 100, and a bolt 111 is passed through the cylinder head cover 114 into one of the bolt holes 106, whereby the cylinder head cover 14 is fixed to the cylinder head 13 and the camshaft holder 100 as shown in FIG. 24.

Further, the first support portion 101 of the camshaft holder 100 has an ignition plug insertion hole 107 formed therein, the ignition plug insertion hole 107 communicates with the ignition plug hole 33 provided in the cylinder head 13, and the ignition plug 29 is inserted in the ignition plug insertion hole 107. In the top surface of the camshaft holder 100 is formed a wall portion 108 having an oval shape so as to surround the ignition plug insertion hole 107. The ignition plug insertion hole 107 and one of the bolt insertion holes 105 are disposed adjacently in the area surrounded by the wall portion 108. Because the bolt insertion hole 105 is formed so as to be positioned adjacently to the ignition plug insertion hole 107 in the area surrounded by the wall portion 108, the ignition plug insertion hole 107 and the bolt insertion hole 105 are close to each other in a small area, the cylinder head 13 can be miniaturized, and the strength of the camshaft holder 100 can be improved by the arrangement in which the periphery of the ignition plug insertion hole 107 and the bolt insertion hole 105 is surrounded by the wall portion 108.

Figure 22:
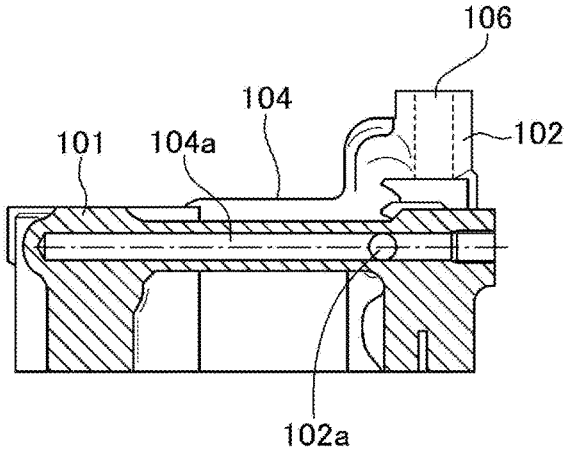
FIG. 22 is a sectional view taken along the line XXII-XXII of FIG. 20.
Figure 23:
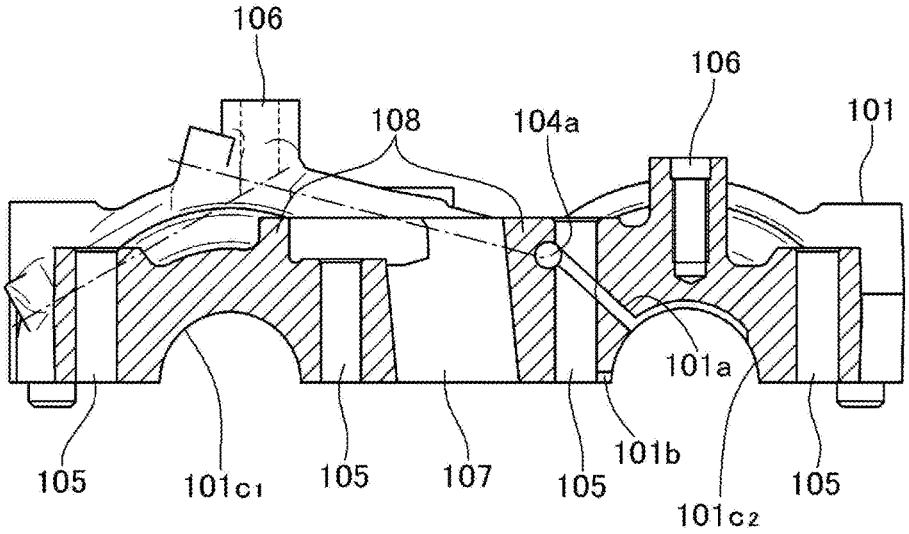
FIG. 23 is a sectional view taken along the line XXIII-XXIII of FIG. 20.

As shown in FIG. 21, the second support portion 102 of the camshaft holder 100 has an oil passage 102*a* therein, the oil passage 102*a* communicating with an oil passage (not illustrated) provided in the cylinder head 13. As shown in FIG. 22, the exhaust side connecting portion 104 has therein an oil passage 104*a* formed to extend to the first support portion 101, and the oil passage 104*a* communicates with the oil passage 102*a*, the oil passage 102*a* being provided in the second support portion 102. As shown in FIG. 23, the oil passage 104*a* is made to communicate with one of the bolt insertion holes 105, the bolt insertion hole 105 being positioned on the inner side of the bearing portion 101$c_2$. The bearing portion 101$c_2$ is formed within the first support portion 101 and supports the exhaust camshaft 53. An oil passage 101*a* and an oil passage 101*b* are provided, the oil passage 101*a* is lead from one of the bolt insertion hole 105 to the upper side of the bearing portion 101$c_2$. The oil passage 101*b* is formed in a groove shape in the lower surface of the camshaft holder 100 and communicates with the lower side of the bearing portion 101$c_2$. When the oil is fed under pressure by an oil pump not shown, the oil flows through an oil passage (not illustrated) formed in the cylinder head 13 and is supplied from the oil passage to the oil feeding hole 81*b*, the oil feeding hole 81*b* being formed in the first camshaft support portion 81 of the cylinder head 13, which camshaft support portion 81 supports the intake camshaft 52. The oil is supplied to the gap between the intake camshaft 52 and the bearing half section 81$a_1$ of the cylinder head 13, and is then fed to the oil passages 101*a* and 101*b* of the camshaft holder 100. The oil is then supplied to the gap between the exhaust camshaft 53 and the bearing portion 101$c_2$ of the camshaft holder 100. Because the oil is supplied to the bearing portion 101$c_2$ of the camshaft holder 100 in the two directions, initial lubricating performance to the bearing portion 101$c_2$ at the time of the start-up of the engine 10 is improved.

The first support portion 101 and the second support portion 102 of the camshaft holder 100 are connected to the intake side connecting portion 103 on the intake side, and the first support portion 101 and the second support portion 102 are connected to the exhaust side connecting portion 104 on the exhaust side as shown in FIG. 20. As FIG. 24 shows, the intake side connecting portion 103 is formed so as to be positioned above the intake camshaft 52 to cover the upper part of the intake camshaft 52, and the exhaust side connecting portion 104 is formed so as to be positioned above the exhaust camshaft 53 to cover the upper part of the exhaust camshaft 53. It is thus possible to collect oil splashed from the valve drive mechanism 50 and to supply the oil to the intake camshaft 52 and the exhaust camshaft 53.

On the exhaust camshaft 53 is provided a decompression device 64 as shown in FIG. 14. The decompression device 64 is arranged on the right side of the exhaust camshaft 53, and maintains the exhaust valve 41 in the valve open state when the rotational speed of the engine 10 is low. The decompression device 64 includes a decompression shaft 65, a decompression weight 66, a spring 67, a decompression pin 68, a stopper member 69, and a bolt 77. The decompression weight 66 is provided integrally with an end of the decompression shaft 65. The spring 67 is wound around the decompression shaft 65 and urges the decompression shaft 65 in a predetermined direction. The decompression device 64 is configured as follows.

Figure 15:
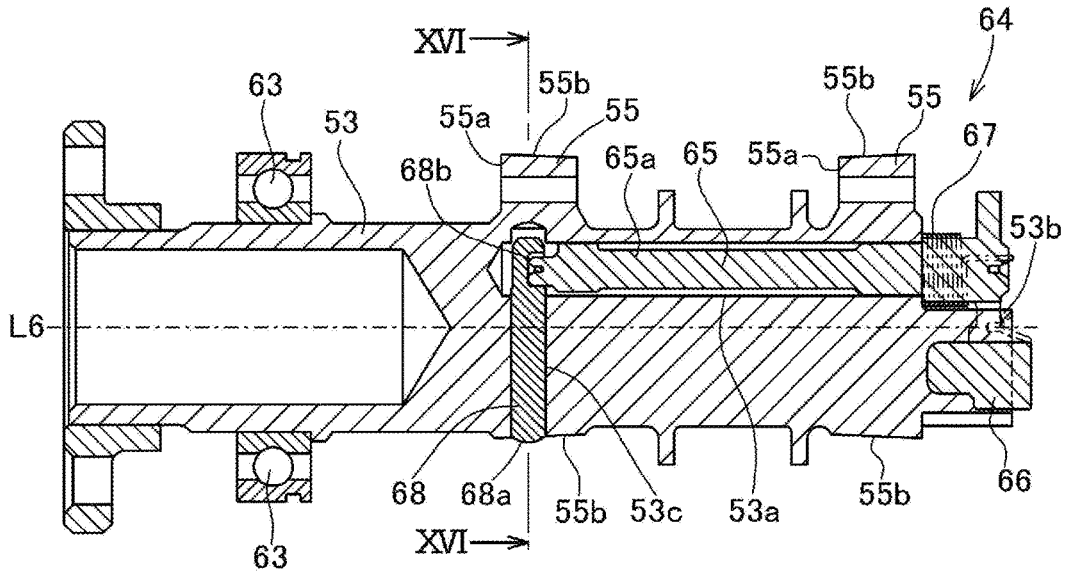
FIG. 15 is a vertical cross-sectional view of the exhaust camshaft.
Figure 16:
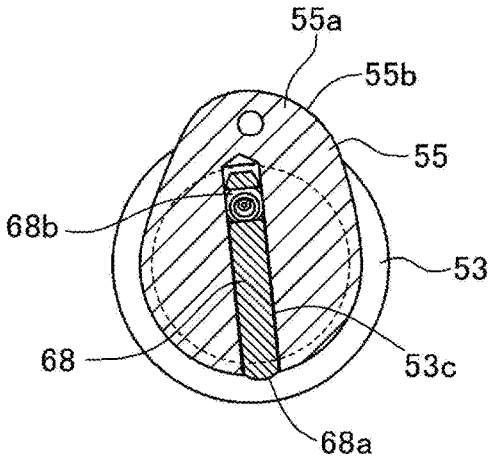
FIG. 16 is a cross-sectional view taken along the line XVI-XVI of FIG. 15.
Figure 17:
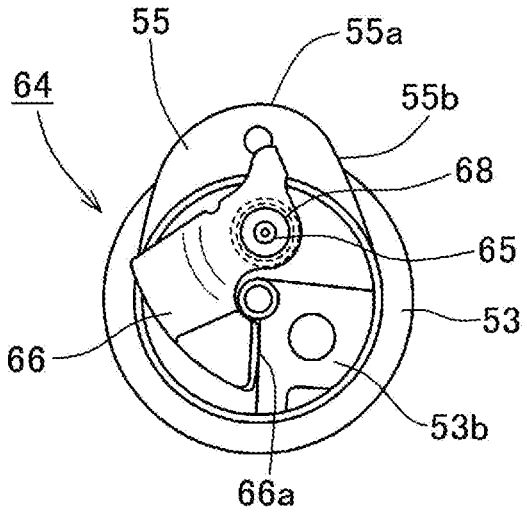
FIG. 17 is a right side view of the exhaust camshaft in a decompression state.

As shown in FIG. 15, one end of the exhaust camshaft 53 is formed with a decompression shaft insertion hole 53*a*, and the decompression shaft 65 is inserted in the decompression shaft insertion hole 53*a* in parallel with the exhaust cam axis L6. Referring also to FIG. 16, one of the exhaust cams 55 in the axially intermediate portion of the exhaust camshaft 53 is formed with a decompression pin insertion hole 53*c*, which extends orthogonally to the decompression shaft insertion hole 53*a* and penetrates the cam surface 55*b*. As shown in FIGS. 15, 16 and 17, the end of the exhaust camshaft 53, where the decompression device 64 is provided, is formed with a stopper portion 53*b*, and the decompression weight 66 of the decompression shaft 65 is adapted to abut on the stopper portion 53*b* so as to be prevented from further turning, the decompression weight 66 having been urged by the spring 67. An abutting surface 66*a* for abutting contact with the stopper portion 53*b* of the decompression weight 66 is formed in a curved shape with a predetermined radius of curvature.

As illustrated in FIG. 15, the inner distal end of the decompression shaft 65 engages with a notch portion 68*b* of the decompression pin 68 inserted in the decompression pin insertion hole 53*c*. The decompression shaft 65 is inserted in the decompression shaft insertion hole 53*a*, such that rotation of the decompression shaft 65 causes an outer distal end portion 68*a* of the decompression pin 68 to protrude and retract relative to the cam surface 55*b* of the exhaust cam 55.

Figure 18:
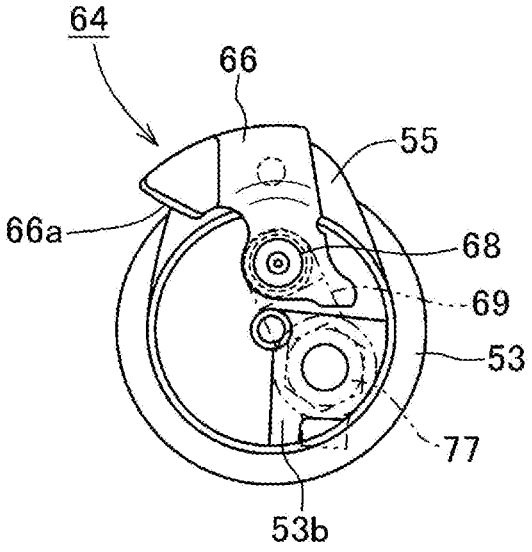
FIG. 18 is a right side view of the exhaust camshaft in a decompression-released state.

At the time of the start-up of the internal combustion engine 10, the decompression device 64 is in the state shown in FIG. 17, in which the abutting surface 66*a* of the decompression weight 66 is made to abut on the stopper portion 53*b* under the urging force of the spring 67, so that the outer distal end portion 68*a* of the decompression pin 68 is in a decompression state in which the outer distal end portion 68*a* protrudes from the cam surface 55*b* of the exhaust cam 55. When the rotational speed of the engine 10 reaches a value equal to or higher than a predetermined value, the decompression shaft 65 is rotated as shown in FIG. 18, and the decompression weight 66 is swung radially outward under the centrifugal force of the decompression weight 66 to be separated from the stopper portion 53*b*, whereby the distal end portion 68*a* of the decompression pin 68 is retracted behind the cam surface 55*b* of the exhaust cam 55, to establish a decompression-released state. Because the abutting surface 66*a* of the decompression weight 66 is formed in a curved shape having a predetermined radius, even when oil is attached to the abutting surface 66*a* of the decompression weight 66, the oil is prevented from adhering to the stopper portion 53*b*, and therefore the decompression-released state can be securely achieved at a predetermined timing, and the stopper portion 53*b* of the exhaust camshaft 53 can be subjected to surface treatment to be mirror-finished.

As shown in FIG. 24, a portion protruding upward in a box shape of a rectangular parallelepiped is formed on the upper part of the cylinder head cover 14, and the inside of the portion is formed into a breather chamber 120, plural separation walls being formed in the breather chamber 120. As FIG. 3 shows, this breather chamber 120 is disposed on the higher side of the cylinder head 13 as viewed in the direction of the crank shaft axis L2, and for this reason, the oil returning performance of the oil collected by the breather chamber 120 is improved.

Because the embodiment of the present invention is configured as described above, the advantageous effects described below are obtained.

An embodiment of the internal combustion engine 10 of the present invention includes a pair of intake valves 40 and a pair of exhaust valves 41, the intake camshaft 52, the exhaust camshaft 53, the intake rocker arms 70, the exhaust rocker arms 71, the intake rocker arm support pins 72, and the exhaust rocker arm support pins 73, the intake camshaft 52 including the intake cams 54 that operate the intake valves 40, and the exhaust camshaft 53 including the exhaust cams 55 that operate the exhaust valves 41. The intake rocker arms 70 are interposed between the intake valves 40 and the intake cams 54, the exhaust rocker arms 71 are interposed between the exhaust valves 41 and the exhaust cams 55. The intake rocker arm support pins 72 pivotably support pivotal support base portions 70*a* of the intake rocker arms 70, and the exhaust rocker arm support pins 73 pivotably support pivotal support base portions 71*a* of the exhaust rocker arms 71. The intake valves 40 and the exhaust valves 41 are disposed in a radially extending arrangement. The intake cam surfaces 54*b* of the intake cams 54 are formed in surfaces that incline relative to the intake cam shaft axis L5 of the intake camshaft 52. The intake rocker arm support pins 72 are disposed so as to incline to the same side as the side to which the intake cam surfaces 54*b* incline with respect to the intake cam shaft axis L5 of the intake camshaft 52. The cam surfaces 55*b* of the exhaust cams 55 are formed in surfaces that incline with respect to the exhaust cam shaft axis L6 of the exhaust camshaft 53. The exhaust rocker arm support members 73 are disposed so as to incline to the same side as the side to which the cam surfaces 55*b* incline relative to the exhaust cam shaft axis L6 of the exhaust camshaft 53. The intake rocker arm support pins 72 and the exhaust rocker arm support pins 73 are disposed between the intake camshaft 52 and the exhaust camshaft 53 as viewed along the cylinder axis L1. The pivotal support base portions 70*a* of the intake rocker arms 70 and the pivotal support base portions 71*a* of the exhaust rocker arms 71 are disposed so that the distances thereof from the joining surface P1 of the cylinder head 13 and the cylinder body 12 are different.

With the configuration of the present embodiment as described above, the intake rocker arm support pins 72 and the exhaust rocker arm support pins 73 are disposed between the intake camshaft 52 and the exhaust camshaft 53 as viewed in the cylinder axis L1 direction, and the pivotal support base portions 70*a* of the intake rocker arms 70 and the pivotal support base portions 71*a* of the exhaust rocker arms 71 are disposed so that the distances thereof from the joining surface P1 joining the cylinder head 13 and the cylinder body 12 are different. For this reason, the valve drive mechanism 50 can be disposed compactly, and the internal combustion engine 10 can be miniaturized while preventing interference of the pivotal support base portions 70*a* of the intake rocker arms 70 and the pivotal support base portions 71*a* of the exhaust rocker arms 71, in consideration of the fact that the diameter of the intake valves 40 is smaller than the diameter of the exhaust valves 41. Also, because the position of the pivotal support base portions 70*a* of the intake rocker arms 70 and the pivotal support base portions 71*a* of the exhaust rocker arms 71 are disposed such that the distances thereof from the joining surface P1 between the cylinder head 13 and the cylinder body 12 are changed according to the valve diameters and the lift amounts of the intake valves 40 and the exhaust valves 41, the valve drive mechanism and the angles of radial arrangement of the intake and exhaust valves can be optimized.

Further, by differentiating the height of the pivotal support base portions 70*a* of the intake rocker arms 70 and the height of the pivotal support base portions 71*a* of the exhaust rocker arms 71, the intake rocker arms 70 and the exhaust rocker arms 71 can be disposed so as to be closer to the center area between the intake camshaft 52 and the exhaust camshaft 53, increased lengths of the rocker arms can be secured, and inclination of the cam follower portions of the intake rocker arms 70 and the exhaust rocker arms 71 can be reduced.

Because the intake rocker arm support pins 72 and the exhaust rocker arm support pins 73 are inserted respectively to the rocker arm support boss portion 90 formed integrally with the cylinder head 13 and because the intake rocker arm support pins 72 and the exhaust rocker arm support pins 73 are prevented from slipping off by the common or same slipping-off preventing member 75, the number of the component parts can be reduced and the assembling work can be improved since the intake rocker arm support pins 72 and the exhaust rocker arm support pins 73 share the slipping-off preventing member 75. Further, because the intake rocker arms 70 and the exhaust rocker arms 71 are supported by the intake rocker arm support pins 72 and the exhaust rocker arm support pins 73 which are both inserted in the rocker arm support boss portion 90, the intake rocker arms 70 and the exhaust rocker arms 71 can be securely supported by a simple mechanical structure, and the assembling work can be further simplified.

Because the slipping-off preventing members 75 are disposed so as to incline relative to the cylinder axis L1 and because the intake rocker arm support pins 72 and the exhaust rocker arm support pins 73 are prevented from slipping off respectively by the base portion 75*a* and the tip portion 75*c* of the slipping-off preventing member 75, the intake rocker arm support pins 72 and the exhaust rocker arm support pins 73 can be disposed to be closer to the center area between the intake camshaft 52 and the exhaust camshaft 53 while the distance between the intake rocker arm support pins 72 and the exhaust rocker arm support pins 73 is increased by the slipping-off preventing member 75. The slipping-off preventing member 75 are disposed so as to incline relative to the cylinder axis L1, so that the cylinder head 13 can be further miniaturized while sharing the slipping-off preventing member 75, and arrangement of the valve drive mechanism and the angle of radial arrangement can be optimized. Further, inclination of the cam follower portion of each of the rocker arms can be reduced by securing the length of the rocker arms.

Furthermore, because the slipping-off preventing member 75 is formed such that the tip portion 75*c* is of reduced diameter relative to the base portion 75*a*, and because the middle thread portion 75*b* for fixing the slipping-off preventing member 75 to the cylinder head 13 is provided between the base portion 75*a* and the tip portion 75*c*, the middle thread portion 75*b* can securely fixed both the intake rocker arm support pins 72 and the exhaust rocker arm support pins 73, while the intake rocker arm support pins 72 and the exhaust rocker arm support pins 73 are disposed apart, and the supporting rigidity can be increased.

The first camshaft support portion 81 and the second camshaft support portion 82 are arranged in the cylinder head 13, to support the intake camshaft 52 and the exhaust camshaft 53, the camshaft holder 100 is fixedly secured to the first camshaft support portion 81 and the second camshaft support portion 82, to rotatably support the intake camshaft 52 and the exhaust camshaft 53. The joining surface P2 joining the first and second camshaft support portions 81 and 82 and the camshaft holder 100 is inclined relative to the joining surface P1 joining the cylinder body 12 and the cylinder head 13, the exhaust rocker arm support pins 73 are inserted in the rocker arm support boss portion 90 on the side where the distance between the joining surfaces P1 and P2 is shorter as viewed in the direction of the axis L2 of the crankshaft 20, and the intake rocker arm support pins 72 are inserted in the rocker arm support boss portion 90 on the side where the distance between the joining surfaces P1 and P2 is longer. As a result of the above configuration, the side of the shorter distance can be made the side of the exhaust valves 41 having a smaller valve diameter and the side of the longer distance can be made the side of the intake valve 40 having a larger valve diameter, and the valve drive mechanism can be optimally disposed in the cylinder head 13, and the cylinder head 13 can be miniaturized.

Because the positioning grooves 91 are arranged in the rocker arm support boss portion 90 of the cylinder head 13 so as to be continuous to the surface of the rocker arm support boss portion 90, and the positioning grooves 91 receive the pivotal support base portions 70*a* of the intake rocker arms 70 and the pivotal support base portions 71*a* of the exhaust rocker arms 71, the positioning grooves 91 can function as lubrication grooves for capturing the oil splashed to the rocker arm support boss portion 90 and for supplying the oil to the pivotal support base portions 70*a* and 71*a* of the intake rocker arms 70 and the exhaust rocker arms 71, so that effectiveness of the lubrication of the pivotally support base portion 70*a* of the intake rocker arms 70 and the pivotal support base portions 71*a* of the exhaust rocker arms 71 is improved.

While the embodiment of the present invention has been described above in detail, the present invention is not limited to the embodiment described above, and other various changes can be made. Also, the internal combustion engine 10 of the present invention is not limited for use on the motorcycle 1, but can also be used widely to other kinds of the saddle-ride type vehicles.

LIST OF REFERENCE SIGNS

10 . . . Internal combustion engine
12 . . . Cylinder body
13 . . . head
14 . . . Cylinder head cover
40 . . . Intake valve
41 . . . Exhaust valve
52 . . . Intake camshaft
53 . . . Exhaust camshaft

54 . . . Intake cam
54*b* . . . Cam surface
55 . . . Exhaust cam
55*b* . . . Cam surface
70 . . . Intake rocker arm
70*a* . . . Pivotal support base portion
71 . . . Exhaust rocker arm
71*a* . . . Pivotal support base portion
72 . . . Intake rocker arm support pin
73 . . . Exhaust rocker arm support pin
75 . . . Slipping-off preventing member
75*a* . . . Base portion
75*b* . . . Middle thread portion
75*c* . . . Tip portion
81 . . . First camshaft support portion
82 . . . Second camshaft support portion
90 . . . Rocker arm support boss portion
91 . . . Positioning groove
100 . . . Camshaft holder
L1 . . . Cylinder axis
L2 . . . Crank shaft axis
L5 . . . Intake cam axis
L6 . . . Exhaust cam axis
P1 . . . Joining surface
P2 . . . Joining surface

The invention claimed is:

1. An internal combustion engine, comprising:

a cylinder body having a cylinder bore with a cylinder axis;

a cylinder head joined to the cylinder body on a joining surface;

a pair of intake valves and a pair of exhaust valves;

an intake camshaft having intake cams for pressing the intake valves, respectively;

an exhaust camshaft having exhaust cams for pressing the exhaust valves, respectively;

intake rocker arms interposed between the intake cams and the intake valves, respectively;

exhaust rocker arms interposed between the exhaust cams and the exhaust valves, respectively;

intake rocker arm support members for pivotably supporting pivotal support base portions of the intake rocker arms, respectively; and exhaust rocker arm support members for pivotably supporting pivotal support base portions of the exhaust rocker arms, respectively:

wherein the intake valves and the exhaust valves are disposed in radial directions with respect to the cylinder axis;

the intake cams include intake cam surfaces inclined at inclination angles relative to an axis of the intake camshaft, respectively;

the intake rocker arm support members are disposed to incline at inclination angles corresponding to the inclination angle of the intake cam surfaces, respectively;

the exhaust cams include exhaust cam surfaces inclined at inclination angles relative to an axis of the exhaust camshaft, respectively;

the exhaust rocker arm support members are disposed to incline at inclination angles corresponding to the inclination angle of the exhaust cam surfaces, respectively;

the intake rocker arm support members and the exhaust rocker arm support members are disposed between the intake camshaft and the exhaust camshaft as viewed along the cylinder axis; and the pivotal support base portions of the intake rocker arms and the pivotal support base portions of the exhaust rocker arms are disposed such that distances from the joining surface to the intake rocker arm support members and to the exhaust rocker arm support members are different.

2. The internal combustion engine according to claim 1, wherein:

the intake rocker arm support members are intake rocker arm support pins, the exhaust rocker arm support members are exhaust rocker arm support pins, the intake rocker arm support pins and the exhaust rocker arm support pins being inserted in a rocker arm support boss portion formed integrally on the cylinder head; and the intake rocker arm support pins and the exhaust rocker arm support pins are prevented from slipping off by slipping-off preventing members, which are shared by both the intake rocker arm support pins and the exhaust rocker arm support pins.

3. The internal combustion engine according to claim 2, wherein:

the slipping-off preventing members are disposed so as to incline relative to the cylinder axis, and the intake rocker arm support pins and the exhaust rocker arm support pins are prevented from slipping off, respectively, by a base portion and a tip portion of the slipping-off preventing members.

4. The internal combustion engine according to claim 3, wherein:

each of the slipping-off preventing members is formed such that the tip portion thereof has a reduced diameter relative to the base portion thereof; and the slipping-off preventing member includes a thread portion provided between the base portion and the tip portion, the thread portion fixing the slipping-off preventing member to the cylinder head.

5. The internal combustion engine according to claim 4, wherein:

the cylinder head has camshaft support portions for supporting the intake camshaft and the exhaust camshaft;

a camshaft holder is fixed integrally on the camshaft support portions and rotatably supports intake camshaft and the exhaust camshaft;

the camshaft support portions and the camshaft holder are joined on a joining surface, the joining surface being inclined relative to the joining surface joining the cylinder body and the cylinder head;

the exhaust rocker arm support pins are inserted in the rocker arm support boss portion on a side where the distance between the joining surface and the joining surface is shorter; and the intake rocker arm support pin are inserted in the rocker arm support boss portion on a side where the distance between the joining surface and the joining surface is longer.

6. The internal combustion engine according to claim 5, wherein:

the rocker arm support boss portion of the cylinder head has positioning grooves formed in the surface of the rocker arm support boss portion, the positioning grooves receiving the pivotal support base portions of the intake rocker arms and the pivotal support base portions of the exhaust rocker arms, respectively.

* * * * *